US008913944B2

(12) United States Patent
Sakon et al.

(10) Patent No.: US 8,913,944 B2
(45) Date of Patent: Dec. 16, 2014

(54) CLEANING BLADE, AND IMAGE FORMING APPARATUS AND PROCESS CARTRIDGE USING THE CLEANING BLADE

(71) Applicants: Yohta Sakon, Kanagawa (JP); Masahiro Ohmori, Kanagawa (JP)

(72) Inventors: Yohta Sakon, Kanagawa (JP); Masahiro Ohmori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1 day.

(21) Appl. No.: 13/739,197

(22) Filed: Jan. 11, 2013

(65) Prior Publication Data

US 2013/0189012 A1 Jul. 25, 2013

(30) Foreign Application Priority Data

Jan. 24, 2012 (JP) ..... 2012-011709
Oct. 30, 2012 (JP) ..... 2012-239229

(51) Int. Cl.
*G03G 21/00* (2006.01)

(52) U.S. Cl.
CPC ..... *G03G 21/0017* (2013.01)
USPC ..... 399/350

(58) Field of Classification Search
CPC ..... G03G 21/0011; G03G 2221/0005
USPC ..... 399/350
See application file for complete search history.

(56) References Cited

U.S. PATENT DOCUMENTS

2011/0217102 A1* 9/2011 Ohmori et al. ..... 399/350

FOREIGN PATENT DOCUMENTS

| | | |
|---|---|---|
| JP | 9-127846 | 5/1997 |
| JP | 2004-233818 | 8/2004 |
| JP | 2009-223071 | 10/2009 |
| JP | 2010-152295 | 7/2010 |

* cited by examiner

*Primary Examiner* — Hoang Ngo
(74) *Attorney, Agent, or Firm* — Cooper & Dunham LLP

(57) ABSTRACT

A cleaning blade including a strip-shaped elastic blade having at least one obtuse-angled edge on a tip portion thereof, and a cover layer, which is located on a surface of the tip portion of the elastic blade including the obtuse-angled edge and which is harder than the elastic blade. The obtuse-angled edge having the cover layer thereon is contacted with a moving surface of a member to be cleaned to remove a powdery material from the moving surface of the member.

14 Claims, 5 Drawing Sheets

PROJECTED IMAGE OF PARTICLE
PERIMETER: C1
AREA: S

CIRCLE WITH AREA OF S
PERIMETER: C2
AREA: S

CLEANING BLADE, AND IMAGE FORMING APPARATUS AND PROCESS CARTRIDGE USING THE CLEANING BLADE

CROSS-REFERENCE TO RELATED APPLICATIONS

This patent application is based on and claims priority pursuant to 35 U.S.C. §119 to Japanese Patent Applications Nos. 2012-011709 and 2012-239229, filed on Jan. 24, 2012 and Oct. 30, 2012, respectively, in the Japan Patent Office, the entire disclosure of which is hereby incorporated by reference herein.

FIELD OF THE INVENTION

This disclosure relates to a cleaning blade, and an image forming apparatus and a process cartridge using the cleaning blade.

BACKGROUND OF THE INVENTION

In electrophotographic image forming apparatuses, residual toner remaining on the surface of an image bearing member such as photoreceptors even after a toner image thereon is transferred onto a recording medium or an intermediate transfer medium is removed therefrom using a cleaning device.

Strip-shaped cleaning blades made of an elastic material such as polyurethane rubbers are typically used as a cleaning member of such a cleaning device because of having advantages such that the cleaning device has simple structure and good cleanability. Among such cleaning blades, a cleaning blade in which one end thereof is supported by a supporter, and an edge of the other end is contacted with a surface of an image bearing member to block and scrape off residual toner on the image bearing member, thereby removing the residual toner from the surface of the image bearing member.

In attempting to fulfill a recent need for high quality images, there are image forming apparatuses using substantially spherical toner (hereinafter sometimes referred to as polymerization toner), which has a relatively small particle diameter and which is prepared by a method such as polymerization methods. Since polymerization toner has such an advantage as to have a higher transfer efficiency than pulverization toner, which has been conventionally used, the polymerization toner can fulfill the need. However, polymerization toner has such a drawback as not to be easily removed from an image bearing member by a cleaning blade, resulting in occurrence of a cleaning problem. This is because such polymerization toner has a high circularity and a small particle diameter, and easily passes through a small gap between the tip of a cleaning blade and the surface of an image bearing member.

In attempting to prevent occurrence of such a cleaning problem (toner passing problem), a technique such that the pressure to the cleaning blade contacted with the surface of the image bearing member is increased is often used to enhance the cleanability of the cleaning blade. However, when the contact pressure of such a cleaning blade is increased, the friction between the cleaning blade and the image bearing member is increased, and thereby the tip of the cleaning blade is pulled by the moving surface of the image bearing member in the moving direction of the image bearing member.

Specifically, as illustrated in FIG. 11(*a*), a cleaning blade 62 is pulled by the surface of an image bearing member 123 in a moving direction (indicated by an arrow) of the image bearing member due to increase of friction between the blade and the image bearing member, thereby causing a problem (hereinafter referred to as an everted-tip problem) in that an edge 62*c* of a tip surface 62*a* of the blade 62 is everted.

In this regard, since the thus everted tip has a restoring force, the tip tends to vibrate, resulting in generation of fluttering sounds (hereinafter referred to as a fluttering sound problem). In addition, when the cleaning operation is continued while the edge 62*c* of the cleaning blade 62 is everted, a portion of the tip surface 62*a* of the cleaning blade 62, which portion is apart from the edge 62*c* by few micrometers, is abraded as illustrated in FIG. 11(*b*). When the cleaning blade 62 is further used for the cleaning operation, the portion of the tip surface 62*a* of the blade 62 is further abraded, resulting in lack of the edge 62*c* of the blade 62 as illustrated in FIG. 11(*c*). The cleaning blade 62 having no edge cannot remove residual toner from the surface of the image bearing member 123, thereby causing a cleaning problem in that an abnormal image in which background thereof is soiled with residual toner is formed. In FIGS. 11(*a*)-(*c*), numeral 62*b* denotes a lower surface of the blade 62, which faces a surface to be cleaned.

In attempting to prevent occurrence of the cleaning problem, there is a proposal such that a cover layer made of a resin, which is harder than polyurethane rubber and has a pencil hardness of from B to 6H, is formed at least on the edge of the tip surface of a cleaning blade made of a polyurethane elastomer. It is described therein that by forming such a cover layer, friction between the tip of the cleaning blade and a surface of an image bearing member can be reduced while enhancing the abrasion resistance of the cleaning blade. In addition, it is described therein that since friction between the tip of the cleaning blade and a surface of an image hearing member can be reduced, occurrence of the everted-tip problem can be prevented. Further, it is described therein that since the cover layer is hard and is not easily deformed, occurrence of the everted-tip problem can be prevented more securely.

However, such an elastic cleaning blade having a high-hardness cover layer causes the following cleaning problem.

Specifically, under severe cleaning conditions such that a large amount of toner remains on the surface of an image bearing member, for example, after continuous formation of solid toner images, the cleaning blade often causes the cleaning problem. This is because a cover layer with high hardness is formed on the edge, a portion of the tip surface of the blade and a portion of the lower surface of the blade in the longitudinal direction of the edge, and therefore the elastic property of the elastic blade is deteriorated by the cover layer. When the elastic property of the blade is deteriorated, the cleaning blade cannot be satisfactorily contacted with the surface of an image bearing member (i.e., the pressure of the cleaning blade to the surface of an image bearing member varies) if the image bearing member is eccentric or the surface thereof is waved.

In addition, when solid images are continuously produced and a large amount of residual toner is present on the surface of the image bearing member, the large amount of toner is collected at the tip of a cleaning blade by being blocked by the cleaning blade. In this case, the pressure of the collected toner to the cleaning blade increases. Therefore, the residual toner at the tip of the cleaning blade tends to pass through a relatively large gap formed between a portion of the cleaning blade and the surface of the image bearing member, which are contacted with each other at a relatively low pressure (due to eccentricity of the image bearing member or waving of the surface thereof), resulting in occurrence of the cleaning problem.

In this regard, when the cover layer is thick, the elastic property of the elastic blade is deteriorated seriously because the cover layer has larger rigidity, and therefore such a cleaning problem is seriously caused because the cleaning blade cannot be satisfactorily contacted with the surface of an image bearing member, i.e., the cleaning blade has poor ability to follow an image bearing member. Therefore, when a high-hardness cover layer is formed on the surface of the tip portion of a blade including the edge of the blade, the cover layer is as thin as possible so that the cleaning blade has good ability to follow an image bearing member.

In addition, it is inevitable that the portion of a cleaning blade contacted with an image hearing member is abraded as the cleaning blade is used, and even such a high-hardness cover layer formed on the edge of the cleaning blade is also abraded gradually.

In this regard, when a cover layer is formed on the tip portion of an elastic blade, it is impossible that portions of the cover layers on the lower surface 62*b* of the blade, the tip surface 62*a* of the blade, and the edge 62*c* of the blade have the same thickness. Since such a cover layer is typically formed by a coating method such as spray coating and dip coating, it is hard to form a cover layer on an edge of a blade due to surface tension of the coating liquid. Namely, the cover layer formed on the edge 62*c* is thinner than the cover layers formed on the tip surface 62*a* and the lower surface 62*b* of the blade.

In order to maintain the ability of a cleaning blade to follow an image bearing member, a cover layer is typically formed such that portions of the cover layer on the tip surface 62*a* and the cover layer on the lower surface 62*b* are relatively thin. In this case, the portion of a cover layer 623 on the edge 62*c* is much thinner than the portions of the cover layer on the tip surface 62*a* and the lower surface 62*b* as illustrated in FIG. 12. Therefore, the portion of the cover layer 623 on the edge 62*c* is abraded rapidly so as to be worn out when repeatedly used.

When the cover layer 623 on the edge 62*c* is worn out and the edge 62*c* of the elastic blade 623 is directly contacted with an image bearing member, the edge 62*c* starts to be abraded. Since the edge 62*c* has a right angle, the edge is rapidly abraded so as to be worn out when contacted with the image bearing member. In this case, the contact area of the cleaning blade with the image bearing member increases and the contact pressure of the cleaning blade significantly decreases, thereby deteriorating the cleanability of the cleaning blade.

For these reasons, the inventors recognized that there is a need for a cleaning blade which can clean a surface of an object to be cleaned without causing the above-mentioned cleaning problems such as the toner passing problem, the everted-tip problem, and the fluttering sound problem.

BRIEF SUMMARY OF THE INVENTION

As an aspect of this disclosure, a cleaning blade is provided which includes a strip-shaped elastic blade having at least one obtuse-angled edge on a tip portion thereof, and a cover layer, which is located on a surface of the tip portion of the elastic blade including the obtuse-angled edge and which is harder than the elastic blade. The obtuse-angled edge having the cover layer thereon is contacted with a moving surface of a member to be cleaned to remove a powdery material from the moving surface of the member.

As another aspect of this disclosure, an image forming apparatus is provided which includes an image bearing member, a toner image forming device to form a toner image on a surface of the image bearing member, a transferring device to transfer the toner image on the image bearing member to a recording medium, and a cleaner to remove the toner remaining on the surface of the image bearing member after the toner image is transferred using the cleaning blade mentioned above.

As yet another aspect of this disclosure, a process cartridge is provided which includes at least an image bearing member to bear a toner image thereon, and a cleaner to remove the toner remaining on the surface of the image bearing member after the toner image is transferred using the cleaning blade mentioned above. The process cartridge is detachably attachable to an image forming apparatus as a single unit.

The aforementioned and other aspects, features and advantages will become apparent upon consideration of the following description of the preferred embodiments taken in conjunction with the accompanying drawings.

DETAILED DESCRIPTION OF THE INVENTION

Initially, an example of the image forming apparatus of this disclosure will be described by reference to an electrophotographic printer.

Figure 1:
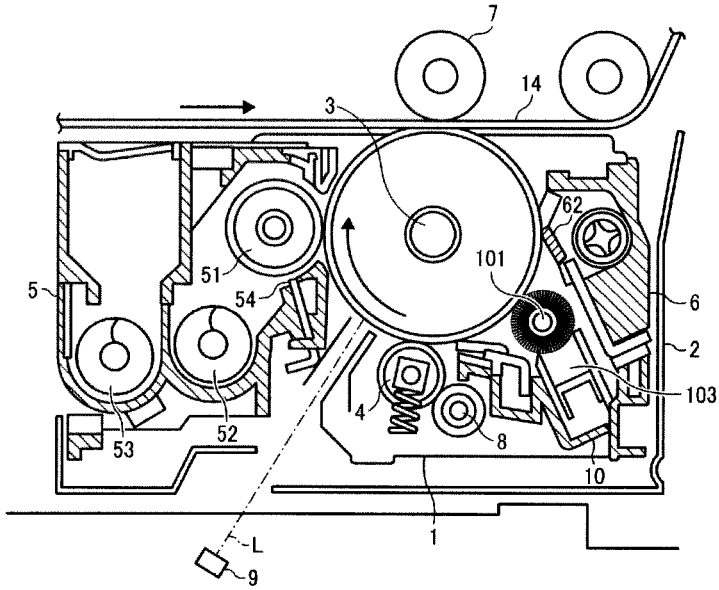
FIG. 1 is a schematic view illustrating a printer as an example of the image forming apparatus of this disclosure.

FIG. 1 is a schematic view illustrating the main portion of a printer as an example of the image forming apparatus of this disclosure. The printer produces monochromatic images according to image data read by an image reading portion (not shown in FIG. 1).

As illustrated in FIG. 1, the printer includes a drum-shaped photoreceptor 3 serving as an image bearing member. The shape of the photoreceptor 3 is not limited thereto, and sheet-shaped photoreceptors, endless belt-shaped photoreceptors and the like can also be used.

Around the photoreceptor 3, a charger 4 to charge the photoreceptor, a developing device 5 to develop an electrostatic latent image on the photoreceptor to form a toner image thereon, a transferring device 7 to transfer the toner image onto a recording medium, and a cleaner 6 to remove residual toner remaining on the photoreceptor even after the toner image is transferred are arranged. In addition, a lubricant applicator 10 to apply a lubricant to the surface of the photoreceptor, and a discharging lamp (not shown) are also arranged around the photoreceptor 3.

The charger 4 charges a surface of the photoreceptor 3 so that the surface has a predetermined potential with a predetermined polarity. The photoreceptor 3 thus charged by the charger 4 is irradiated with light L emitted by an irradiator 9 (i.e., a latent image forming device) according to image data, thereby forming an electrostatic latent image on the photoreceptor 3. Numeral 8 denotes a cleaner to clean the surface of the charger 4.

The developing device 5 has a developing roller 51 serving as a developer bearing member. A development bias is applied to the developing roller 51 by a power source (not shown). A supplying screw 52 and an agitating screw 53 are provided in a casing of the developing device 5 to feed the developer in opposite directions in the casing so that the developer is charged so as to have a charge with a predetermined polarity. In addition, a doctor 54 is provided in the developing device 5 to form a developer layer having a predetermined thickness on the surface of the developing roller 51. The developer is charged so as to have a charge with the predetermined polarity by the supplying screw 52 and the agitating screw 53. The charged developer is drawn up by the developing roller 51 is regulated by the doctor 54 to form a developer layer on the developing roller, and the charged toner in the developer layer is adhered to an electrostatic latent image on the photoreceptor 3 at a development region, in which the developing roller 51 is opposed to the photoreceptor 3, resulting in formation of a toner image on the surface of the photoreceptor 3. In this image forming apparatus, the combination of the charger 4, the irradiator 9, and the developing device 5 serves as a toner image forming device.

The cleaner 6 includes a fur brush 101, and a cleaning blade 62. The cleaning blade 62 is contacted with the surface of the photoreceptor 3 in such a manner as to counter the rotated photoreceptor 3. The cleaning blade 62 will be described later in detail.

The lubricant applicator 10 includes a solid lubricant 103, and a pressing spring (not shown) to press the solid lubricant 103 toward the fur brush 101 serving as a lubricant applicator to apply the lubricant to the surface of the photoreceptor 3. The solid lubricant 103 is supported by a bracket (not shown) while being pressed toward the fur brush 101 by the pressing spring. The solid lubricant 103 is scraped by the fur brush 101, which is driven by the photoreceptor 3 so as to rotate (counterclockwise in FIG. 1), thereby applying the lubricant 103 to the surface of the photoreceptor 3. By thus applying the lubricant, the friction coefficient of the surface of the photoreceptor 3 can be controlled so as to be not higher than 0.2.

Known chargers such as corotrons, scorotrons, solid state chargers, and other chargers can also be used for the charger 4. Among these chargers, contact chargers, and non-contact short-range chargers are preferable because of having advantages such that the charging efficiency is high, the amount of ozone generated in a charging operation is small, and the charger can be miniaturized.

Specific examples of light sources for use in the irradiator and the discharger include any known light emitting devices such as fluorescent lamps, tungsten lamps, halogen lamps, mercury lamps, sodium lamps, light emitting diodes (LEDs), laser diodes (LDs), and electroluminescent lamps (ELs).

In order to irradiate the photoreceptor 3 with light having a wavelength in a desired range, sharp cut filters, bandpass filters, infrared cut filers, dichroic titters, interference filters, color temperature converting filters, and the like can be used.

Among these light sources, LEDs and LDs are preferably used because of having advantages such that the irradiation energy is high, and light having a relatively long wavelength of from 600 nm to 800 nm can be emitted.

Next, the image forming operation of the printer will be described.

Upon receipt of a print execution signal from an operating portion (not shown) such as an operation panel, predetermined voltages or currents are applied to the charger 4 and the developing roller 51 at predetermined times. Similarly, predetermined voltages or currents are applied to the light sources of the irradiator and the discharging lamp at predetermined times. In synchronization with these operations, the photoreceptors 3 are rotated in a direction indicated by an arrow by a driving motor (not shown).

When the photoreceptor 3 is rotated, the surface thereof is charged by the charger 4 so as to have a predetermined potential with a predetermined polarity. Next, a light beam L emitted by the irradiator according to the image data irradiates the charged surface of the photoreceptor 3, thereby forming an electrostatic latent image on the surface of the photoreceptor 3.

The surface of the photoreceptor 3 bearing the electrostatic latent image is rubbed by a magnetic brush of the developer formed on the developing roller 51. In this case, the negatively-charged toner in the magnetic brush on the developing rollers 51 is moved toward the electrostatic latent image by the development bias applied to the developing roller 51, resulting in formation of a toner image on the surface of the photoreceptor 3.

Thus, the electrostatic latent image formed on the photoreceptor 3 is subjected to a reverse development treatment using a negative toner. In this example, a N/P developing method using a non-contact charging roller is used, but the developing method is not limited thereto.

The toner image thus formed on the photoreceptor 3 is transferred onto a recording medium fed from a recording medium feeding portion to a transfer region, in which the photoreceptor 3 is opposed to the transferring device 7 with a transfer belt 14 therebetween, after passing through a nip of a pair of registration rollers. In this case, the recording medium is timely fed to the transfer region by the pair of registration rollers so that the toner image on the photoreceptor 3 is transferred onto a proper portion of the recording medium. In addition, a predetermined transfer bias is applied to the recording medium in the transferring process. The recording medium bearing the toner image thereon is separated from the photoreceptor 3, and is then fed to a fixing device (not shown). When the recording medium passes through the fixing device, the toner image is fixed to the recording medium upon application of heat and pressure thereto. The recording medium bearing the fixed toner image thereon is discharged from the printer.

After the transferring process, the surface of the photoreceptor 3 is cleaned by the cleaner to remove residual toner therefrom, and is then discharged by the discharging lamp.

In this printer, the photoreceptor 3 and the process device including the charger 4, the developing device 5, and the cleaner 6 are contained in a case 2 so that the devices can be detachably attachable to the printer as a process cartridge 1. In this example, the process cartridge including the photoreceptor 3 and the process device is replaced with a new process cartridge, but it is also possible that each of the photoreceptor 3, the charger 4, the developing device 5, and the cleaner 6 is independently replaced with a new one. The process cartridge of this disclosure includes at least an image bearing member and a cleaner including the cleaning blade of this disclosure.

Next, the toner for use in the printer will be described.

The toner is preferably a toner having a high circularity and a small particle diameter to produce high quality images. Such a toner is preferably prepared by polymerization methods such as suspension polymerization methods, emulsion polymerization methods, and dispersion polymerization methods. The average circularity of the toner is preferably not less than 0.97, and the volume resistivity thereof is preferably not greater than 5.5 μm to produce high resolution toner images.

The average circularity of toner is measured using a flow particle image analyzer FPIA-2000 from Sysmex Corp. The procedure is as follows:

(1) initially, 100 to 150 ml of water, from which solid foreign materials have been removed, 0.1 to 0.5 ml of a surfactant (e.g., alkylbenzenesulfonate) and 0.1 to 0.5 g of a sample (i.e., toner) are mixed to prepare a dispersion;

(2) the dispersion is further subjected to a supersonic dispersion treatment for 1 to 3 minutes using a supersonic dispersion machine to prepare a dispersion including particles at a concentration of from 3,000 to 10,000 pieces/μl;

(3) the dispersion is set in the analyzer so as to pass through a detection area formed on a plate in the analyzer; and (4) the particles of the sample passing through the detection area are optically detected by a CCD camera and then the shapes of the toner particles and the distribution of the shapes are analyzed with an image analyzer to determine the average circularity of the sample.

Figure 2A:
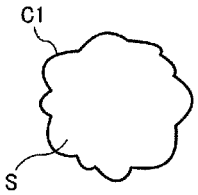
FIGS. 2A and 2B are schematic views for describing the circularity of toner.
Figure 2B:
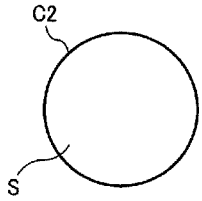

The method for determining the circularity of a particle will be described by reference to FIGS. 2A and 2B. When the projected image of a particle has a perimeter C1 and an area S as illustrated in FIG. 2A, and the perimeter of a circle having the same area S is C2 as illustrated in FIG. 2B, the circularity of the particle is obtained by the following equation.

$$\text{Circularity}=C2/C1$$

The average circularity of a toner is obtained by averaging circularities of toner particles.

The volume average particle diameter of toner can be determined, for example, by an instrument such as COULTER MULTICIZER 2e manufactured by Beckman Coulter Inc. Specifically, the number-based particle diameter distribution data and the volume-based particle diameter distribution data are sent to a personal computer via an interface manufactured by Nikkaki Bios Co., Ltd. to be analyzed. The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl;

(2) 2 to 20 mg of a sample (toner) to be measured is added into the mixture;

(3) the mixture is subjected to an ultrasonic dispersion treatment for about 1 to 3 minutes; and (4) the dispersion is added to 100 to 200 ml of an aqueous solution of an electrolyte in a beaker so that the mixture includes the particles at a predetermined concentration; and (5) the diluted dispersion is set in the instrument to measure particle diameters of 50,000 particles using an aperture of 100 μm to determine the volume average particle diameter of the sample.

In this regard, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted.

In this regard, the volume average particle diameter is obtained by the following equation.

$$\text{Volume average particle diameter}=\Sigma XfV/\Sigma fV,$$

wherein X represent the representative particle diameter of each channel. V represents the volume of the particle having the representative particle diameter, and f represents the number of particles having particle diameters in the channel.

Figure 11:
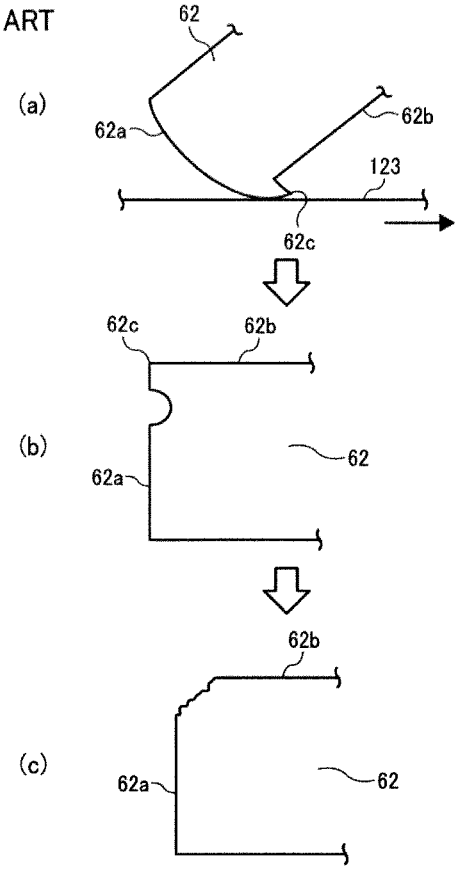
FIG. 11 RELATED ART
FIGS. 11(*a*)-11(*c*) are schematic views illustrating a conventional cleaning blade whose tip is everted (FIG. 11(*a*)), whose tip is locally abraded (FIG. 11(*b*)), and whose edge is worn out (FIG. 11(*c*)) when the cleaning blade is repeatedly used.

When such a polymerization toner as mentioned above is used, residual toner remaining on the photoreceptor 3 cannot be satisfactorily removed therefrom using a cleaning blade compared to a case where a conventional pulverization toner is removed by the cleaning blade, thereby easily forming an abnormal image in which background thereof is soiled with residual toner. In attempting to improve the cleanability (i.e., to prevent formation of such an abnormal image) by increasing the contact pressure of the cleaning blade 62 to the photoreceptor 3, another problem in that the cleaning blade is rapidly abraded is caused. In this case, friction between the cleaning blade 62 and the photoreceptor 3 is increased, and thereby the tip of the cleaning blade 62 is pulled by the photoreceptor 3 in the moving direction of the photoreceptor as mentioned above by reference to FIG. 11(*a*). In this regard, the thus everted tip of the cleaning blade 62 has a restoring force, and the tip tends to vibrate, resulting in generation of fluttering sounds. In addition, when the cleaning blade 62 in such a state is continuously used, the cleaning blade may lack the edge portion thereof as illustrated in FIG. 11(*c*).

Figure 3:
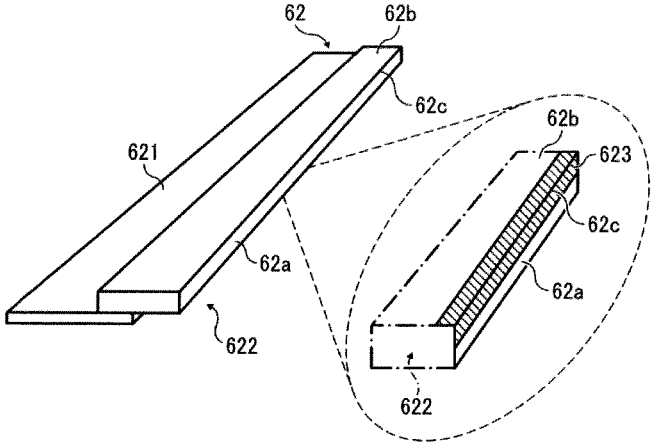
FIG. 3 RELATED ART
FIG. 3 is a schematic perspective view illustrating a conventional cleaning blade.
Figure 4:
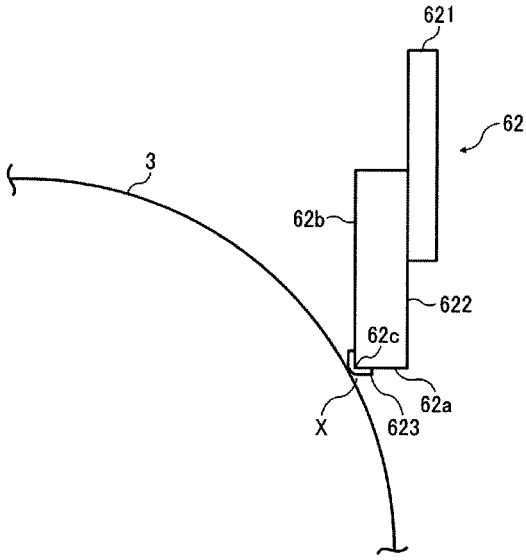
FIG. 4 RELATED ART
FIG. 4 is a schematic cross-sectional view illustrating the conventional cleaning blade illustrated in FIG. 3.

FIG. 3 is a perspective view illustrating a conventional cleaning blade, and FIG. 4 is a cross-sectional view illustrating the conventional cleaning blade.

Referring to FIGS. 3 and 4, the cleaning blade 62 includes a strip-shaped holder 621 which is made of a rigid material such as metals and hard plastics, and a strip-shaped elastic blade 622.

The elastic blade 622 is fixed to an end portion of the holder 621, for example, by an adhesive. The other end portion of the holder 621 is supported (cantilevered) by a case of the cleaner 6.

In order that the elastic blade 622 can be satisfactorily contacted with the surface of the photoreceptor 3 even if the photoreceptor 3 is eccentric or the surface thereof is waved, the elastic blade 622 is typically made of a material having a high modulus of repulsion elasticity such as rubbers.

A cover layer 623 is formed on a tip portion of the elastic blade 622 including a right-angled edge 62*c*. The cover layer 623 is formed by a method such as spray coating, dip coating and screen printing so as to cover the right-angled edge 62*c*. The cover layer 623 is typically made of a material having a high hardness.

When a cover layer having a high hardness is formed on the cleaning blade 622, the following problem tends to be caused.

Specifically, under severe cleaning conditions such that a large amount of toner is adhered to the surface of an image bearing member such as continuous formation of solid toner images, the cleaning problem tends to be caused. The reason therefor is considered to be that since the cover layer 623 having a high hardness is formed on the tip surface 62*a* and the lower surface 62*b* in the longitudinal direction, the elasticity of the elastic blade 622 is deteriorated by the cover layer 623, thereby deteriorating the ability of the edge 62*c* to follow the photoreceptor 3. Therefore, under such severe cleaning conditions, the cleaning problem is caused.

In a printer having a lubricant applicator, the lubricant applied on the surface of the photoreceptor is deteriorated by charging of a charger such as charging rollers. In this case, the lubricant tends to become viscous, thereby deteriorating the ability of the edge 62*c* to follow the photoreceptor 3, resulting in occurrence of the cleaning problem.

This cleaning problem becomes prominent when the cover layer 623 is thick, because the elasticity of the elastic blade 622 is easily deteriorated by rigidity of the cover layer 623 and thereby the ability of the edge 62*c* to follow the surface of the photoreceptor 3 is deteriorated. Therefore, in a cleaning blade in which a cover layer having a high hardness is formed on the surface of the elastic blade 622 including the edge 62*c*, it is preferable that the cover layer is to some extent thin so that the edge 62*c* has good ability to follow the surface of the photoreceptor 3.

It is inevitable that the contact portion of the cleaning blade 62 with the photoreceptor 3 is abraded as the cleaning blade is repeatedly used, and the cover layer 623 having a high hardness is also abraded gradually.

When the cover layer 623 is formed on the elastic blade 622, it is difficult to form a cover layer having uniform thickness on a portion of the elastic blade 622 including the edge 62*c* having a right angle. When such a cover layer is formed, a cover layer coating liquid is applied to the surface of the elastic blade 622 by a coating method such as spray coating and dip coating. In this case, it is difficult to form the cover layer on the right-angled edge 62*c* due to the surface tension of the coating liquid. Therefore, the cover layer formed on the edge 62*c* is thinner than the cover layer on the tip surface 62*a* and the lower surface 62*b*.

Figure 12:
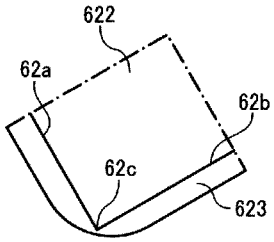
FIG. 12 RELATED ART
FIG. 12 is a schematic view illustrating an edge of a conventional cleaning blade.

The cover layer 623 is typically formed such that the portion of the cover layer on the tip surface 62*a* and the lower surface 62*b* is to some extent thin as illustrated in FIG. 12 to maintain the ability of the cleaning blade 62 to follow the surface of the photoreceptor 3. In this case, the portion of the cover layer 623 on the edge 62*c* is much thinner than the portions of the cover layer on the tip surface 62*a* and the lower surface 62*b*. Therefore, the portion of the cover layer 623 on the edge 62*c* is rapidly abraded so as to be worn out.

When the portion of the cover layer 623 on the edge 62*c* is worn out, the edge 62*c* of the elastic blade 622 is directly contacted with the photoreceptor 3, and the edge 62*c* starts to be abraded. Since the edge 62*c* has a right angle, the edge is rapidly worn out and the shape of the edge is drastically changed, thereby drastically changing the cleanability of the cleaning blade because the contact pressure of the cleaning blade largely changes.

In this regard, it is considered that the edge 62*c* is mainly abraded by a free material (hereinafter referred to as a free external additive) of the external additive (such as inorganic materials, e.g., silica), which has been added to the toner in the toner manufacturing process. Such a free external additive passes through the contact portion of the cleaning blade with the photoreceptor because the free external additive cannot be scraped off by the edge 62*c* of the cleaning blade 62. Therefore, the edge 62*c* is subjected to scratch-abrasion by the free external additive. Such an inorganic material is typically added to polymerization toner, which is used for forming high quality images, in a relatively large amount compared to conventional toner (pulverization toner) to improve fluidity of the polymerization toner. Therefore, the amount of free external additive in polymerization toner is relatively large compared to that in conventional toner. Therefore, when polymerization toner is used, the edge 62*c* is abraded more seriously than in a case where conventional pulverization toner is used. Therefore, in order to securely perform the cleaning operation, it is preferable to use a toner, which does not easily pass through the contact portion of the cleaning blade and the photoreceptor, and to reduce abrasion of the edge 62*c* by a free external additive.

In addition, since such a free external additive tends to be adhered to the surface of the photoreceptor 3 via a lubricant supplied to the surface of the photoreceptor 3, the free external additive is fixed to the surface of the photoreceptor 3 together with the lubricant due to interaction between the free external additive and the lubricant, thereby strengthening the abrasion action. Therefore, it is preferable to improve the durability of the edge of the cleaning blade 62.

In addition, recently low temperature fixable toner is used to save energy of image forming apparatuses. Such low temperature fixable toner tends to easily cause problems such that the toner is easily fixed to a cleaning blade, and forms a toner film on the surface of the photoreceptor. Therefore, it is preferable for the cleaning blade to have good cleanability, i.e., to have good releasability from such low temperature fixable toner and to prevent formation of such a toner film on the surface of the photoreceptor. Further, it is preferable for the edge of the cleaning blade 62 to hardly deform in the cleaning operation so that the cleaning blade can maintain good robustness, i.e., the cleaning blade can stably perform good cleaning operation even when the environmental conditions change and/or the amount of toner remaining on the surface of the photoreceptor changes.

The elastic blade 622 of the cleaning blade 62 of this disclosure has an obtuse-angled edge which is to be contacted with the surface of the photoreceptor 3, and a cover layer is formed on a surface of the tip portion of the elastic blade 622 including the obtuse-angled edge. Since the edge has an obtuse angle, a cover layer can be relatively easily formed on the edge compared to an edge having a right angle because effect of the surface tension of the cover layer coating liquid can be reduced, thereby making it possible to form a cover layer having uniform thickness on the edge, and portions of the tip surface 62*a* and the lower surface 62*b*. Therefore, even when a relatively thin cover layer is formed not to deteriorate the elasticity of the elastic blade, the thickness of the cover layer on the edge is greater than that of the cover layer formed on an edge having a right angle, thereby making it possible to extend the life of the cover layer, i.e., the time until which the cover layer 623 is worn out. Therefore, the effect of the cover layer 623 can be produced for a long period of time while the edge of the cleaning blade can have a good ability to follow the photoreceptor 3.

When the cleaning blade 62 is repeatedly used for a long period of time and the cover layer 623 thereof is worn out, the obtuse-angled edge is directly contacted with the photoreceptor 3 and starts to be abraded. In this case, since the edge has an obtuse angle, sudden change of the shape of the edge can be prevented unlike the edge 62*c* of a conventional cleaning blade having a right angle. Therefore, serious change of the cleanability of the cleaning blade due to change of the contact pressure of the cleaning blade caused by the sudden change of the shape of the edge can be prevented. Therefore, the cleaning blade of this disclosure can maintain good cleanability for a longer period of time than in a case of using a conventional cleaning blade.

In addition, with respect to the problem in that a free external additive passes through an edge while abrading the edge, the force of such a free external additive applied to an obtuse-angled edge can be spread relatively widely compared to a case where the edge has a right angle, and therefore the abrasion loss can be reduced. Further, the abrasion loss of the edge caused by a free external additive adhered to the surface of the photoreceptor 3 can also be reduced.

Although the edge cannot directly block such a free external additive, penetration of a free external additive into the nip between the edge of the cleaning blade and the photoreceptor and passing of the free external additive through the nip can be prevented by the dam effect caused by toner particles accumulated on the upstream side of the cleaning blade relative to the rotation direction of the photoreceptor 3. Since the obtuse-angled edge of the cleaning blade of this disclosure has a better ability to follow the surface of the photoreceptor 3 than a conventional edge having a right angle and therefore the behavior of the edge is stable, collapse of the accumulated toner particles on the upstream side of the cleaning blade can be prevented. Therefore, the obtuse-angled edge of the cleaning blade of this disclosure can produce better dam effect than a right-angled edge of a conventional cleaning blade.

By forming the cover layer 623 on an edge of a cleaning blade, occurrence of the problem in that low temperature fixable toner is adhered to the cleaning blade can be prevented. In this regard, since an obtuse-angled edge can push away toner particles along the surface of the photoreceptor 3 relatively strongly compared to a right-angled edge, i.e., since an obtuse-angled edge pushes toner particles toward the surface of the photoreceptor 3 relatively weakly compared to a right-angled edge, occurrence of a filming problem in that a film of toner is formed on the surface of the photoreceptor can be prevented. Thus, an obtuse-angled edge of the cleaning blade of this disclosure has good toner releasability while preventing occurrence of the filming problem. In addition, the cleaning blade of this disclosure can maintain good robustness, i.e., the cleaning blade can stably perform a good cleaning operation even when the environmental conditions change and/or the amount of toner remaining on the surface of a photoreceptor changes, The cleaning blade of this disclosure, which has at least one obtuse-angled edge to be contacted with a member to be cleaned, will be described in detail.

The cleaning blade of this disclosure has substantially the same structure as that of the cleaning blade illustrated in FIGS. 3 and 4 except that the contact edge has an obtuse angle.

Specifically, the elastic blade 622 is fixed to an end portion of the holder 621, for example, by an adhesive. The other end portion of the holder 621 is supported (cantilevered) by a case of the cleaner 6.

In order that the elastic blade 622 can be satisfactorily contacted with the surface of the photoreceptor 3 even if the photoreceptor 3 is eccentric or the surface thereof is waved, the elastic blade 622 is typically made of a material having a high modulus of repulsion elasticity, and rubbers having a urethane group such as urethane rubbers are preferably used therefor.

In addition, the elastic blade 622 is preferably made of a urethane rubber having a JIS A hardness of from 68° to 80° at 25° C. When the hardness is higher than 80°, the blade tends to lack flexibility. Specifically, when such a hard blade is attached to the holder 621 while being slanted, the end portions of the blade in the longitudinal (axis) direction thereof are contacted with the photoreceptor 3 at different contact pressures, resulting in defective cleaning (i.e., deterioration of the cleanability of the cleaning blade).

In contrast, when the hardness is lower than 68°, the contact edge of the cleaning blade 62 tends to be everted if the contact pressure is increased to satisfactorily remove a polymerization toner from the surface of the photoreceptor 3. In this case, a portion of the lower surface 62*b* of the cleaning blade 62 is contacted with the surface of the photoreceptor 3, thereby seriously increasing the contact area of the cleaning blade with the photoreceptor (i.e., seriously decreasing the contact pressure of the cleaning blade), resulting in deterioration of the cleanability of the cleaning blade 62. Particularly, since the above-mentioned phenomenon tends to remarkably occur in this example in which the tip portion of the cleaning blade has a cover layer, the hardness is preferably in the range mentioned above.

Figure 5:
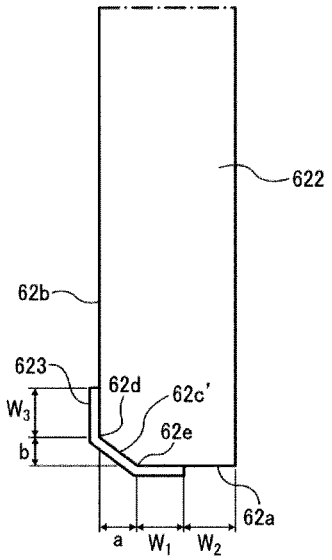
FIG. 5 is a schematic cross-sectional view illustrating the fore-end portion of an example of the cleaning blade of this disclosure.
Figure 9:
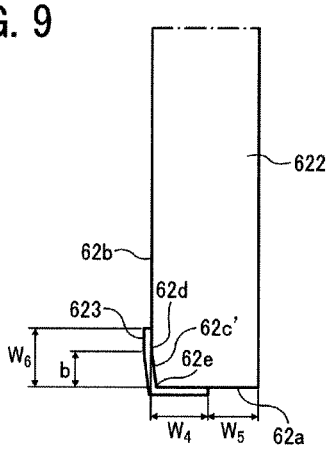
FIG. 9 is a schematic cross-sectional view illustrating the fore-end portion of another example of the cleaning blade of this disclosure.

A cover layer 623 is formed on a tip portion of the elastic blade 622 including an obtuse-angled contact edge (such as edges 62*d* or 62*e* illustrated in FIGS. 5 and 9). The cover layer 623 is formed by a method such as spray coating, dip coating and screen printing so as to cover the edge 62*c*. The cover layer 623 is preferably made of a material having a higher hardness than the elastic blade 622 so as to be rigid and undeformable. When the elastic blade has such a cover layer, occurrence of the problem in the edge is everted can be prevented.

The cover layer 623 is preferably made of a resin, and more preferably an ultraviolet crosslinked resin. Specifically, by applying an ultraviolet crosslinkable resin to the obtuse-angled edge (62*d* or 62*e*), and then irradiating the applied ultraviolet crosslinkable resin with ultraviolet rays, a cover layer having a desired harness can be easily prepared, and a cleaning blade can be easily prepared at low costs.

When such an ultraviolet crosslinked resin is prepared, ultraviolet crosslinkable monomers having a molecular weight of from 300 to 1,500 per one functional group are preferably used. When the molecular weight per one functional group is greater than 1,500, the cover layer becomes too brittle, and the contact edge tends to be everted. In this case, the problem in that the tip surface is abraded as illustrated in FIG. 11(*c*) is caused, and it becomes difficult for the cleaning blade to maintain good cleanability for a long period of time. In contrast, when the molecular weight per one functional group is less than 300, the cover layer becomes too rigid. In this case, the abrasion resistance of the cover layer 623 tends to deteriorate or the fluttering sound problem tends to be easily caused.

The thickness of the cover layer 623 is preferably from 0.1 μm to 2 μm. When the thickness is less than 0.1 μm, the rigidity of the cover layer 623 deteriorates, and thereby the contact edge of the cleaning blade 62 tends to be easily everted. In contrast, when the thickness is greater than 2 μm, toner particles tend to easily pass through the contact portion of the cleaning blade 62 with the photoreceptor 3, thereby easily causing the defective cleaning problem. Since the cover layer is formed by adhering a liquid material (coating liquid) to the elastic blade similarly to spray coating and dip coating, it is hard to form the cover layer having a desired thickness on an edge (such as the right-angled edge 62*c*) due to the surface tension of the liquid material. Therefore, the thickness of the cover layer 623 tends to increase as the distance from the edge increases particularly when the edge has a right angle.

When the thickness of the cover layer 623 is greater than 2 μm, the difference between the thickness of the cover layer on the contact edge and a portion of the cover layer apart from the edge increases, and therefore the edge has a curved surface. In this case, a space X (illustrated in FIG. 4) formed on an upstream side from the contact point and formed by tip surface 62*a* and the surface of the photoreceptor 3 narrows. Therefore, when toner particles accumulate in the space X after repeated cleaning operations, the toner particles cannot escape from the space X because the photoreceptor 3 rotates counterclockwise and therefore the toner particles in the space X are pushed toward the downstream side relative to the rotation direction of the photoreceptor 3, resulting in occurrence of the cleaning problem.

In the cleaning blade of this disclosure, an obtuse-angled edge on the elastic blade 622 is preferably formed by grinding a right-angled edge (such as the edge 62*c*). By grinding one right-angled edge, the edge is separated into two new obtuse-angled edges, wherein the total of the inner angles of the new obtuse-angled edges is 270°. Each of the new obtuse-angled edges can be used for a cleaning operation by selecting proper contact conditions. The grinding treatment can be satisfactorily performed, for example, by grinding the edge with a fine grinding member including an abrasive having a small particle size. The particle size of the abrasive is preferably not greater than 3 μm so that the ground surface has high smoothness.

Next, the method for grinding a right-angled edge (62*c*) will be described by reference to examples 1 and 2.

Initially a first embodiment will be described.

FIG. 5 is an enlarged cross-sectional view illustrating the fore-end portion of an example of the cleaning blade of this disclosure.

Referring to FIG. 5, an edge of a cleaning blade 622, which is formed by the tip surface 62*a* and the lower surface 62*b* (i.e., which is an intersection of the tip surface 62*a* and the lower surface 62*b*) is ground to form an edge portion 62*c*' and obtuse-angled edges 62*d* and 62*e*, and a cover layer 623 is formed on end portions of the tip surface 62*a* and the lower surface 62*b*, the edge portion 62*c*', and the obtuse-angled edges 62*d* and 62*e*.

Figure 6:
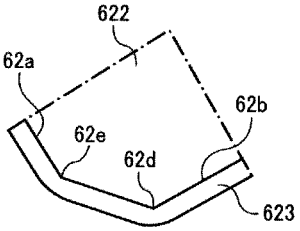
FIG. 6 is a schematic cross-sectional view illustrating the tip portion of the cleaning blade illustrated in FIG. 5.

FIG. 6 is a schematic cross-sectional view illustrating the tip portion of the cleaning blade illustrated in FIG. 5. Since each of the edges 62*d* and 62*e* has an obtuse angle, the cover layer 623 can be easily formed on the edges 62*d* and 62*e* because the effect of the surface tension of the coating liquid used for forming the cover layer can be reduced. Therefore, a cover layer, which has a relatively uniform thickness compared to a case where the edge 62*c* has a right angle, can be formed on the tip portion of the blade 622 including the edges 62*d* and 62*e*. Therefore, even when the cover layer 623 is formed so as to be thin to an extent that the elastic property of the elastic blade 622 is not deteriorated, the portions of the cover layer 623 on the edges 62*d* and 62*e* is thicker than a portion of the cover layer formed on an edge having a right angle. Therefore, the life of the cover layer 623 can be extended (i.e., the time by which the cover layer 623 is worn out can be extended).

Figure 7:
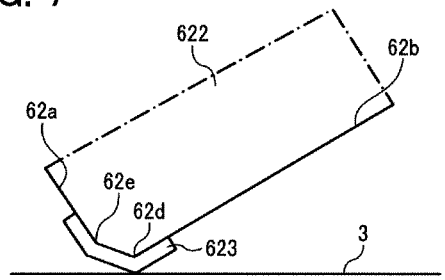
FIG. 7 is a schematic view illustrating the cleaning blade illustrated in FIG. 5 which is contacted with a photoreceptor.

FIG. 7 is a schematic view illustrating the cleaning blade illustrated in FIG. 5 which is contacted with a photoreceptor. In the cleaning blade illustrated in FIG. 7, one (i.e., the edge 62*d*) of the obtuse-angled edges 62*d* and 62*e* is contacted with a surface of the photoreceptor 3 to clean the surface of the photoreceptor. Since the cover layer 623 is formed on the edge 62*d*, the cover layer 623 is contacted with the surface of the photoreceptor 3 to remove residual toner from the surface of the photoreceptor when the cleaning blade is in the initial state. Since a relatively thin cover layer 623 having uniform thickness is formed on the tip portion of the cleaning blade 622 including the edge 62*d* so as not to deteriorate the elastic property of the cleaning blade, the cleaning blade can have good ability to follow the photoreceptor 3 while the cover layer 623 can maintain good cleaning effect for a long period of time.

Even when the cover layer 623 is worn out after long repeated used, the edge 62*d*, which also has an obtuse angle, is contacted with the surface of the photoreceptor 3. Therefore, occurrence of change in shape of the contact portion of the cleaning blade 622 can be prevented, thereby preventing occurrence of a cleaning problem caused by the change in shape of the contact portion. Accordingly, the cleaning blade can stably maintain good cleanability for a long period of time.

When the edge 62*c*' (illustrated in FIG. 5) is formed by grinding, each of the widths (a) and (b) of the treated portions of the tip surface 62*a* and the lower surface 62*b* is preferably from 5 μm to 20 μm. When the widths (a) and (b) are greater than the range, the width of the abraded portion of the edge after repeated use excessively increases, and the durability of the cleaning blade often deteriorates. In contrast, when the widths (a) and (b) are less than the range, the effect of the edge grinding (blunting) treatment is little.

As illustrated in FIG. 5, the cover layer 623 on the tip surface 62*a* covers the obtuse-angled edge 62*e* and a portion of the tip surface, and a non-covered portion is present on the surface of the tip surface 62*a* while apart from the edge 62*e* such that the width ($W_1$+a) of the portion of the tip surface 62*a* covered with the cover layer 623 is preferably substantially equal to the width ($W_2$) of the non-covered portion of the tip surface 62*a* (i.e., the width ($W_1$+a) is substantially one half of the width of the tip surface 62*a*). In addition, the width ($W_3$+b) of the portion of the lower surface 62*b* covered with the cover layer 623 is preferably substantially equal to the width ($W_1$+a) of the portion of the tip surface 62*a* covered with the cover layer 623. In this regard, since the widths (lengths) (a) and (b) are much smaller than the widths (lengths) $W_1$ and $W_2$, the widths (lengths) $W_1$, $W_2$ and $W_3$ are substantially equal to each other.

When the cover layer 623 is formed on the entire tip surface 62*a* of the cleaning blade 622 and the cover layer formed on the lower surface 62*b* has the same width as that of the cover layer on the tip surface 62*a*, the filming problem in that a toner film is formed on the surface of the photoreceptor 3 and the fluttering sound problem tend to be caused. As mentioned above, it is preferable that the cover layer 623 is made of an ultraviolet cross-linked resin and each of the portions of the cover layer 623 on the tip surface 62*a* and the lower surface 62*b* has a thickness of from 0.1 μm to 2 μm. Thus, by grinding the right-angled edge 62*c* to form the edge 62*c*', and forming the cover layer 623 in such a manner as mentioned above, the moving property of the tip portion of the cleaning blade can be maintained and good cleanability can be imparted to the cleaning blade, thereby preventing occurrence of the filming problem and the fluttering sound problem.

When the right-angled edge 62*c* is ground, the lower surface 62*b* is subjected to the grinding treatment and the surface of the lower surface 62*b* of the elastic blade 622 is properly roughened by the grinding treatment. In this regard, the elastic blade 622 is typically prepared by cutting a urethane rubber sheet prepared by centrifugal molding so that the cut urethane rubbers have a strip-shape.

In this regard, the air surface of the urethane rubber, which surface is not contacted with a wall of the centrifugal molding die and contacted with air, is used as the lower surface 62*b* of the elastic blade 622. The condition of the air surface is different from the condition of the cut surface of the cut urethane rubber having a strip-shape, and is a mirror surface into which a solvent or a coating liquid hardly penetrates unlike the cut surface. By subjecting the air surface to grinding treatment, a solvent or a coating liquid easily penetrates into the treated air surface. When a cover layer coating liquid penetrates into the thus treated surface (lower surface 62*b*), the adhesiveness between the cover layer and the lower surface 62*b* can be enhanced, and occurrence of deformation of the blade due to eversion of the tip can be prevented. In addition, since the contact portion of the cleaning blade is abraded evenly, the cleaning blade can stably perform a cleaning operation.

As mentioned above, the edge of the cleaning blade is easily abraded by a free external additive (such as free silica) of the toner used. Since the edge 62*d* of the cleaning blade contacted with the photoreceptor 3 has an obtuse angle, the edge 62*d* is not easily abraded by such an external additive. In addition, recently toner having a low temperature fixability is used for image forming apparatus to reduce the fixing energy thereof. In this regard, such toner tends to be easily adhered to a cleaning blade of the image forming apparatus while easily causing the filming problem in that a film of the toner is formed on the surface of the photoreceptor. By using the cleaning blade mentioned above for the image forming apparatus using such low temperature fixable toner, chance of occurrence of the problems can be reduced. Further, since the edge 62*d* of the cleaning blade 62 hardly deforms in a cleaning operation, the cleaning blade can maintain good robustness, i.e., the cleaning blade can stably perform a good cleaning operation even when the environmental conditions change and/or the amount of toner remaining on the surface of a photoreceptor changes.

The blade of the first embodiment will be described by reference to a verification experiment 1.

Several cleaning blades were prepared by changing the material constituting the elastic blade 622, the material constituting the cover layer 623, and the width and thickness of the cover layer, and the cleaning blades were evaluated with respect to durability.

1. Elastic Blade

The following five urethane rubbers, which have the following hardness and modulus of repulsion elasticity at 25° C., were used for the elastic blade 622.

Urethane rubber 1: hardness of 68°, modulus of repulsion elasticity of 30% (from Toyo Tire & Rubber Co., Ltd.)

Urethane rubber 2: hardness of 69°, modulus of repulsion elasticity of 50% (from Toyo Tire & Rubber Co., Ltd.)

Urethane rubber 3: hardness of 72°, modulus of repulsion elasticity of 31% (from Toyo Tire & Rubber Co., Ltd.)

Urethane rubber 4: hardness of 75°, modulus of repulsion elasticity of 45% (from Toyo Tire & Rubber Co., Ltd.)

Urethane rubber 5: hardness of 76°, modulus of repulsion elasticity of 32% (from Synztec Co., Ltd.)

The hardness was measured by a durometer from Shimadzu Corp. using the method described in JIS K6253. In this regard, the hardness was measured by overlapping three or more sheets of a urethane rubber having a thickness of about 2 mm so that the thickness of the sample is not less than 6 mm.

The modulus of repulsion elasticity was measured by a resilience tester No. 221 from Toyo Seiki Seisaku-Sho, Ltd. using the method described in JIS K6255. In this regard, the modulus of repulsion elasticity was measured by overlapping two or more sheets of a urethane rubber having a thickness of about 2 mm so that the thickness of the sample 4 mm.

2. Edge Grinding Treatment

The lower surface 62*b* and the tip surface 62*a* of the blade were ground (i.e., the edge 62*c* was ground) using a fine polishing sheet (lapping film sheet) from 3M Japan to form the ground edge 62*c*' (illustrated in FIG. 5). Specifically, the lapping film sheet was fixed on the outer surface of a cylindrical substrate, and an edge (62*c*) of the urethane rubber elastic blade was contacted with the lapping film sheet and the cylindrical substrate was rotated to grind the edge. By using a proper lapping film sheet while changing the treatment time, the targeted ground edge (62*c*') was prepared (i.e., the tip surface 62*a* and the lower surface 62*b* were ground in amounts of (a) and (b) in width as illustrated in FIG. 5).

(1) Grinding Treatment 1
Lapping film sheet: #8000 with grain size of 1 μm
Width (a): 10 μm
Width (b): 10 μm (2) Grinding Treatment 2
Lapping film sheet: #8000 with grain size of 1 μm
Width (a): 20 μm
Width (b): 20 μm (3) Grinding Treatment 3
Lapping film sheet: #15000 with grain size of 0.3 μm
Width (a): 5 μm
Width (b): 5 μm (4) Grinding Treatment 4
Lapping film sheet: #8000 with grain size of 1 μm
Width (a): 25 μm
Width (b): 25 μm By performing the grinding treatments 1-4, elastic blades which are illustrated in FIG. 5 and which have the flat edge 62*c*' and the obtuse-angled edges 62*d* and 62*e*, were prepared.

The following cover layers were used.

(1) Cover Layer 1

| Formula of cover layer coating liquid | |
|---|---|
| Urethane acrylate oligomer 1 (UN-904 from Negami Chemical Industrial Co., Ltd.) | 0.5 parts |
| Urethane acrylate oligomer 2 (UN-2700 from Negami Chemical Industrial Co., Ltd.) | 19.5 parts |
| Polymerization initiator (IRGACURE 184 from BASF Japan Ltd.) | 1 part |
| 2-Butanone serving as solvent | 79 parts |

Hardness of cover layer: Pencil hardness 2H
Friction coefficient: 0.6

(2) Cover Layer 2

| Formula of cover layer coating liquid | |
|---|---|
| Urethane acrylate oligomer 1 (UN-904 from Negami Chemical Industrial Co., Ltd.) | 5 parts |
| Urethane acrylate oligomer 2 (UN-2700 from Negami Chemical Industrial Co., Ltd.) | 15 parts |
| Polymerization initiator (IRGACURE 184 from BASF Japan Ltd.) | 1 part |
| 2-Butanone serving as solvent | 79 parts |

Hardness of cover layer: Pencil hardness 3H
Friction coefficient: 0.5

(3) Cover Layer 3

| Formula of cover layer coating liquid | |
|---|---|
| Urethane acrylate oligomer 1 (UN-904 from Negami Chemical Industrial Co., Ltd.) | 8 parts |
| Urethane acrylate oligomer 2 (UN-2700 from Negami Chemical Industrial Co., Ltd.) | 12 parts |
| Polymerization initiator (IRGACURE 184 from BASF Japan Ltd.) | 1 part |
| 2-Butanone serving as solvent | 79 parts |

Hardness of cover layer: Pencil hardness 6H
Friction coefficient: 0.45

(4) Cover Layer 4.

| Formula of cover layer coating liquid | |
|---|---|
| Urethane acrylate oligomer 1 (UN-3320HA from Negami Chemical Industrial Co., Ltd.) | 5 parts |
| Urethane acrylate oligomer 2 (UN-2700 from Negami Chemical Industrial Co., Ltd.) | 15 parts |
| Polymerization initiator (IRGACURE 184 from BASF Japan Ltd.) | 1 part |
| 2-Butanone serving as solvent | 79 parts |

Hardness of cover layer: Pencil hardness 2H
Friction coefficient: 0.5

(5) Cover Layer 5

| Formula of cover layer coating liquid | |
|---|---|
| Urethane acrylate oligomer 1 (UN-904 from Negami Chemical Industrial Co., Ltd.) | 20 parts |
| Polymerization initiator (IRGACURE 184 from BASF Japan Ltd.) | 1 part |
| 2-Butanone serving as solvent | 79 parts |

Hardness of cover layer: Pencil hardness 9H
Friction coefficient: 0.4

The pencil hardness of the cover layer 623 was measured by a pencil scratching tester KTVF-2380 from COTEC Corp. using the method described in JIS K5600-5-4. The sample was prepared by spraying a cover layer coating liquid on a glass plate of 50 mm in length and 5 mm in width, followed by irradiation of ultraviolet rays as mentioned below to form a cover layer with a thickness of about 5 μm.

The friction coefficient means the maximum static friction coefficient of the cover layer 623 and was measured by a friction tester TRIBOGEAR μ 94i from SHINTO Scientific Co., Ltd. The sample was prepared by spraying a cover layer coating liquid on a glass plate of 50 mm in length and 5 mm in width, followed by irradiation of ultraviolet rays as mentioned below to form a cover layer with a thickness of about 5 μm.

Next, the image forming apparatus used for the verification experiment 1 will be described.

A strip-shaped elastic blade (622) having a thickness of 1.8 mm was prepared using one of the urethane rubbers 1-5 mentioned above. After a right-angled edge (62*c*) of the elastic blade 622 was subjected to a grinding treatment, one of the cover layers 1-5 mentioned above was formed on the tip portion of the elastic blade 622 by spray coating.

Specifically, a cover layer coating liquid was repeatedly applied on a portion of the tip surface (62*a*) of the elastic blade (622) by a spray gun while moving the spray gun at a speed of 10 mm/s so that the cover layer has the predetermined thickness. After drying the coated cover layer coating liquid for 3 minutes to an extent such that the resultant cover layer is not damaged when a finger is contacted therewith, the same coating operation was performed on a portion of the lower surface (62*b*) of the elastic blade to form a cover layer on the portion of the lower surface. After drying the coated cover layer coating liquid for 3 minutes to an extent such that the resultant cover layer is not damaged when a finger is contacted therewith, the resultant cover layer was irradiated with ultraviolet rays under the following conditions.

Power of lamp: 140 W/cm

Irradiating speed of lamp: 5 m/min

Irradiation times: 5 times (5 passes)

In this regard, a masking tape was attached to portions of the tip surface (62*a*) and the lower surface (62*b*) so that the cover layer is formed on the predetermined portions of the tip surface and the lower surface.

Each of the thus prepared elastic blades 622 having the cover layer 623 thereon was fixed to a holder 621 made of a metal plate using an adhesive to prepare cleaning blades 62 of Examples 1-5 and Comparative Examples 1-5. Each of the cleaning blades was set to a color copier IMAGIO MP C4500 from Ricoh Co., Ltd. to be evaluated as described below. In this regard, the entry amount (deformation amount) of the contact edge of the cleaning blade and the setting angle of the blade were controlled so as to be the predetermined amount and angle so that the pressure and the cleaning angle of the blade become constant.

In this verification experiment 1, a polymerization toner was used. The physical properties of the toner are as follows.

1. Toner Particles of the Toner (1) Average circularity: 0.98

(2) Average particle diameter: 4.9 μm

2. External Additives of the Toner (1) First external additive: First silica having small particle diameter (H2000 from Clariant Japan K.K.) and added in an amount of 1.5 parts (based on 100 parts by weight of toner particles)

(2) Second external additive: Titanium oxide having small particle diameter (MT-150AI from Tayca Corp.) and added in an amount of 0.5 parts (3) Third external additive: Second silica having large particle diameter (UFP-30H from Denki Kagaku Kogyo K.K.) and added in an amount of 1.0 part The verification experiment 1 was performed under the following conditions.

1. Environmental conditions in the laboratory: 21° C. 65% RH

2. Cleaning blade evaluation test: A running test in which 50,000 copies of an A4 size chart having an image area ratio of 5% are produced in such a manner that three prints are formed per job and the recording paper is fed in such a direction that the longer sides of the recording paper become perpendicular to the feeding direction was performed.

The evaluation items were as follows.

Evaluation Items

1. Defective cleaning: 20 copies of an A-4 size image including three stripe images with a width of 43 mm (which are perpendicular to the paper feeding direction) were formed after the running test. The stripe images were visually observed to determine whether defective cleaning is caused.

Figure 8:
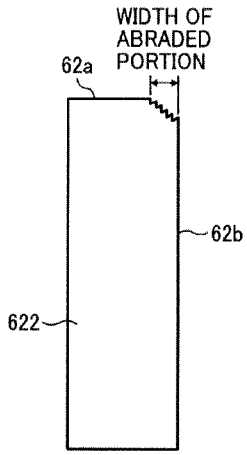
FIG. 8 is a schematic view for describing the width of abraded portion of the cleaning blade.

2. Width of abraded portion: The width of the abraded portion of the blade (illustrated in FIG. 8) was measured. In this regard, the abraded portion includes the ground portion of the edge.

3. Fixation of toner to the edge of the blade: After the running test, the edge and the vicinity of the edge within a range of 1 mm were observed with a microscope to determine whether the toner is fixedly adhered thereto.

The verification experiment 1 includes Examples 1-5 and Comparative Examples 1-5 below. The thickness of the cover layer was determined by observing the cross-section of a cover layer, which was formed on another of the elastic blade by the same method, using a microscope VHX-100 from Keyence Corp. The cross-section was obtained by cutting the elastic blade with the cover layer using a trimming razor from Nisshin EM Corp. for use in preparing a sample for scanning electron microscopes (SEM).

Example 1

The cleaning blade of Example 1 is as follows.
1. Base urethane rubber: urethane rubber 3
2. Edge grinding treatment: edge grinding treatment 1
3. Cover layer: cover layer 2
4. Thickness of cover layer on tip surface 62*a* and lower surface 62*b*: 1.0 μm
5. Width of cover layer on tip surface 62*a*: 0.9 mm The evaluation results are as follows.
1. Width of abraded portion: 13.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Example 2

The cleaning blade of Example 2 is as follows.
1. Base urethane rubber: urethane rubber 5
2. Edge grinding treatment: edge grinding treatment 3
3. Cover layer: cover layer 2
4. Thickness of cover layer on tip surface 62*a* and lower surface 62*b*: 2.0 μm
5. Width of cover layer on tip surface 62*a*: 0.9 mm The evaluation results are as follows.
1. Width of abraded portion: 8.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Example 3

The cleaning blade of Example 3 is as follows.
1. Base urethane rubber: urethane rubber 1
2. Edge grinding treatment: edge grinding treatment 2
3. Cover layer: cover layer 3
4. Thickness of cover layer on tip surface 62*a* and lower surface 62*b*: 0.5 μm
5. Width of cover layer on tip surface 62*a*: 1.0 mm The evaluation results are as follows.
1. Width of abraded portion: 22.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Example 4

The cleaning blade of Example 4 is as follows.
1. Base urethane rubber: urethane rubber 2
2. Edge grinding treatment: edge grinding treatment 1
3. Cover layer: cover layer 1
4. Thickness of cover layer on tip surface 62*a* and lower surface 62*b*: 0.1 μm
5. Width of cover layer on tip surface 62*a*: 0.9 mm The evaluation results are as follows.
1. Width of abraded portion: 14.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Example 5

The cleaning blade of Example 5 is as follows.
1. Base urethane rubber: urethane rubber 3
2. Edge grinding treatment: edge grinding treatment 3
3. Cover layer: cover layer 4
4. Thickness of cover layer on tip surface 62*a* and lower surface 62*b*: 1.0 μm
5. Width of cover layer on tip surface 62*a*: 1.0 mm The evaluation results are as follows.
1. Width of abraded portion: 10.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Comparative Example 1

The cleaning blade of Example Comparative Example 1 is as follows.
1. Base urethane rubber: urethane rubber 2
2. Edge grinding treatment: No edge grinding treatment was performed.
3. Cover layer: cover layer 5
4. Thickness of cover layer on tip surface 62*a* and lower surface 62*b*: 0.5 μm
5. Width of cover layer on tip surface 62*a*: 1.0 mm The evaluation results are as follows.
1. Width of abraded portion: 20.0 μm
2. Fixation of toner to edge of cleaning blade: Toner was not fixedly adhered to the edge.
3. Defective cleaning: Two streak images were formed due to defective cleaning.
4. Fluttering sound problem: The fluttering sound problem was not caused.

Comparative Example 2

The cleaning blade of Example Comparative Example 2 is as follows.
1. Base urethane rubber: urethane rubber 4
2. Edge grinding treatment: edge grinding treatment 4
3. Cover layer: cover layer 2
4. Thickness of cover layer on tip surface 62*a* and lower surface 62*b*: 1.0 μm
5. Width of cover layer on tip surface 62*a*: 1.0 mm The evaluation results are as follows.
1. Width of abraded portion: 30.0 μm
2. Fixation of toner to edge of cleaning blade: Toner was not fixedly adhered to the edge.
3. Defective cleaning: Three streak images were formed due to defective cleaning.
4. Fluttering sound problem: The fluttering sound problem was not caused.

Comparative Example 3

The cleaning blade of Example Comparative Example 3 is as follows.

1. Base urethane rubber: urethane rubber 3
2. Edge grinding treatment: No edge grinding treatment was performed.
3. Cover layer: cover layer 1
4. Thickness of cover layer on tip surface 62*a* and lower surface 62*b*: 3.0 μm
5. Width of cover layer on tip surface 62*a*: 1.8 mm The evaluation results are as follows.

1. Width of abraded portion: 16.0 μm
2. Fixation of toner to edge of cleaning blade: Toner was not fixedly adhered to the edge.
3. Defective cleaning: Two streak images were formed due to defective cleaning.
4. Fluttering sound problem: The fluttering sound problem was caused.

Comparative Example 4

The cleaning blade of Example Comparative Example 4 is as follows.

1. Base urethane rubber: urethane rubber 1
2. Edge grinding treatment: No edge grinding treatment was performed.
3. Cover layer: No cover layer
4. Thickness of cover layer on tip surface 62*a* and lower surface 62*b*: 0 μm
5. Width of cover layer on tip surface 62*a*: 0 mm The evaluation results are as follows.

1. Width of abraded portion: 10.0 μm
2. Fixation of toner to edge of cleaning blade: Toner was fixedly adhered to the edge.
3. Defective cleaning: Three streak images were formed due to defective cleaning.
4. Fluttering sound problem: The fluttering sound problem was not caused.
5. The tip surface 62*a* was abraded due to the everted-tip problem.

Comparative Example 5

The cleaning blade of Example Comparative Example 5 is as follows.

1. Base urethane rubber: urethane rubber 2
2. Edge grinding treatment: No edge grinding treatment was performed.
3. Cover layer: cover layer 3
4. Thickness of cover layer on tip surface 62*a* and lower surface 62*b*: 10.0 μm
5. Width of cover layer on tip surface 62*a*: 1.8 mm The evaluation results are as follows.

1. Width of abraded portion: 18.0 μm
2. Fixation of toner to edge of cleaning blade: Toner was not fixedly adhered to the edge.
3. Defective cleaning: Two streak images were formed due to defective cleaning.
4. Fluttering sound problem: The fluttering sound problem was caused.

The verification experiment 1 is summarized in Tables 1-1 and 1-2 below.

TABLE 1-1

| | Base urethane | Edge grinding treatment | Cover layer | Thickness of cover layer (μm) | Width of cover layer on tip surface (62a) (mm) |
|---|---|---|---|---|---|
| Example 1 | 3 | 1 | 2 | 1.0 | 0.9 |
| Example 2 | 5 | 3 | 2 | 2.0 | 0.9 |
| Example 3 | 1 | 2 | 3 | 0.5 | 1.0 |
| Example 4 | 2 | 1 | 1 | 0.1 | 0.9 |
| Example 5 | 3 | 3 | 4 | 1.0 | 1.0 |
| Comparative Example 1 | 2 | — | 5 | 0.5 | 1.0 |
| Comparative Example 2 | 4 | 4 | 2 | 1.0 | 1.0 |
| Comparative Example 3 | 3 | — | 1 | 3.0 | 1.8 |
| Comparative Example 4 | 1 | — | — | — | — |
| Comparative Example 5 | 2 | — | 3 | 10.0 | 1.8 |

TABLE 1-2

| | Width of abraded portion (μm) | Fixation of toner to cleaning blade | Defective cleaning | Fluttering sound problem | Others |
|---|---|---|---|---|---|
| Example 1 | 13 | No | No | No | |
| Example 2 | 8 | No | No | No | |
| Example 3 | 22 | No | No | No | |
| Example 4 | 14 | No | No | No | |
| Example 5 | 10 | No | No | No | |
| Comparative Example 1 | 20 | No | Two streak images | No | |
| Comparative Example 2 | 30 | No | Three streak images | No | |
| Comparative Example 3 | 16 | No | Two streak images | Yes | |
| Comparative Example 4 | 10 | Yes | Three streak images | No | Tip surface is abraded. |
| Comparative Example 5 | 18 | No | Two streak images | Yes | |

It is clear from Tables 1-1 and 1-2 that the cleaning blades of Examples 1-5, which were prepared by grinding the edge 62*c* (i.e., grinding the lower surface 62*b* and the tip surface 62*a*) and then forming a cover layer thereon, did not cause defective cleaning, the toner fixation problem, the fluttering sound problem, and other problems such as abrasion of the tip edge due to the everted-tip problem even when the blades were repeatedly used. However, the cleaning blades of Comparative Examples 1, 3 and 5, which were prepared by forming a cover layer on a right angled edge 62*c* and the vicinity thereof without grinding the edge, caused defective cleaning and the fluttering sound problem after being repeatedly used. The cleaning blade of Comparative Example 4, which has no cover layer, caused defective cleaning, the toner fixation problem, and the tip surface abrasion problem after being repeatedly used. In addition, it is clear that the width of the ground portions of the tip surface 62*a* and the lower surface 62*b* is preferably from 5 μm to 20 μm. Since the width of the cleaning blade of Comparative Example 2 is greater than the range, the cleaning blade causes defective cleaning after 50,000 copies were produced. This is because the width of the abraded portion of the blade is too large after 50,000 copies were produced.

Next, a second embodiment will be described.

FIG. 9 is an enlarged cross-sectional view illustrating the fore-end portion of another example of the cleaning blade of this disclosure.

In the cleaning blade illustrated in FIG. 9, a portion of the lower surface 62*b* forming a right-angled edge of a cleaning blade 622 is ground to form an edge portion 62*c*' and obtuse-angled edges 62*d* and 62*e*, and a cover layer 623 is formed on end portions of the tip surface 62*a* and the lower surface 62*b*, the edge portion 62*c*', and the obtuse-angled edges 62*d* and 62*e*.

Since each of the edges 62*d* and 62*e* has an obtuse angle, the cover layer 623 can be easily formed on the edges 62*d* and 62*e* because the effect of the surface tension of the cover layer coating liquid can be reduced. Therefore, a cover layer, which has a relatively uniform thickness compared to a case where the edge 62*c* has a right angle, can be formed on the end portions of the blade 622 including the edges 62*d* and 62*e*. Therefore, even when the cover layer 623 is formed so as to be thin to an extent such that the elastic property of the elastic blade 622 is not deteriorated, the portions of the cover layer 623 on the edges 62*d* and 62*e* is thicker than a portion of the cover layer formed on an edge having a right angle. Therefore, the life of the cover layer 623 can be extended (i.e., the time by which the cover layer 623 is worn out can be extended).

Figure 10:
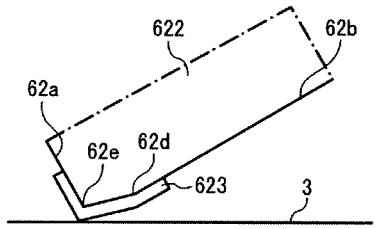
FIG. 10 is a schematic view illustrating the cleaning blade illustrated in FIG. 9 which is contacted with a photoreceptor.

FIG. 10 is a schematic view illustrating the cleaning blade illustrated in FIG. 9 which is contacted with the photoreceptor 3. In the cleaning blade illustrated in FIG. 10, one (i.e., the edge 62*e*) of the obtuse-angled edges 62*d* and 62*e* is contacted with a surface of the photoreceptor 3 to clean the surface of the photoreceptor. Since the cover layer 623 is formed on the edge 62*e*, the cover layer 623 is contacted with the surface of the photoreceptor 3 to remove residual toner from the surface of the photoreceptor when the cleaning blade is in the initial state. Since a relatively thin cover layer 623 having uniform thickness is formed on the tip portion of the cleaning blade 622 including the edge 62*e* so as not to deteriorate the elastic property of the cleaning blade, the cleaning blade can have good ability to follow the photoreceptor 3 while the cover layer 623 can maintain good cleaning effect for a long period of time.

Even when the cover layer 623 is worn out after long repeated used, the edge 62*e*, which also has an obtuse angle, is contacted with the surface of the photoreceptor 3. Therefore, occurrence of change in shape of the contact portion of the cleaning blade 622 can be prevented, thereby preventing occurrence of a cleaning problem caused by the change in shape of the contact portion. Accordingly, the cleaning blade can stably maintain good cleanability for a long period of time.

When the lower surface 62*b* is ground to form the edge 62*c*' (illustrated in FIG. 9), the width (b) of the treated portion of the lower surface 62*b* is preferably from 10 μm to 30 μm. When the width (b) is greater than the range, the width of the abraded portion of the edge after repeated use excessively increases, and the durability of the cleaning blade often deteriorates. In contrast, when the width (b) of the treated portion is less than the range, the effect of the edge grinding (blunting) treatment is little.

As illustrated in FIG. 9, the cover layer 623 on the tip surface 62*a* covers the obtuse-angled edge 62*e* and the vicinity thereof, and a non-covered portion is present on the tip surface 62*a* while apart from the edge 62*e*. In this regard, the width ($W_4$) of the covered portion of the tip surface 62*a* is substantially equal to the width ($W_5$) of the non-covered portion of the tip surface. In addition, the width ($W_6$) of the portion of the lower surface 62*b* covered with the cover layer 623 is preferably substantially equal to the width ($W_4$) of the covered portion of the tip surface 62*a*. When the cover layer 623 is formed on the entire tip surface 62*a* and the cover layer having the same width as that of the cover layer 623 formed on the tip surface 62*a* is formed on the lower surface 62*b*, the filming problem and the fluttering sound problem tend to be caused.

It is preferable that the cover layer 623 is made of an ultraviolet cross-linked resin and each of the portions of the cover layer 623 on the tip surface 62*a* and the lower surface 62*b* has a thickness of from 0.5 μm to 2 μm. Thus, by grinding a right-angled edge (62*c*), and then forming the cover layer 623 in such a manner as mentioned above, the moving property of the tip portion of the cleaning blade can be maintained and good cleanability can be imparted to the cleaning blade, thereby preventing occurrence of the filming problem and the fluttering sound problem, When performing the grinding treatment, the lower surface 62*b* is subjected to the grinding treatment and the ground surface of the lower surface 62*b* of the elastic blade 622 is properly roughened by the grinding treatment. In this regard, a solvent or a coating liquid can easily penetrate into the roughened surface. When a cover layer coating liquid penetrates into the thus treated surface of the lower surface 62*b*, the adhesiveness between the cover layer 623 and the lower surface 62*b* can be enhanced, and occurrence of deformation of the blade due to eversion of the tip can also be prevented. In addition, the contact portion of the cleaning blade is abraded evenly, and therefore the cleaning blade can stably perform a cleaning operation.

As mentioned above, the edge of the cleaning blade is easily abraded by a free external additive (such as free silica) of the toner used. Since the edge 62*e* of the cleaning blade contacted with the photoreceptor 3 has an obtuse angle, the edge 62*e* is not easily abraded by such an external additive. In addition, recently toner having a low temperature fixability is used for image forming apparatus to reduce the fixing energy thereof. In this regard, such toner tends to be easily adhered to a cleaning blade of the image forming apparatus while easily causing the filming problem in that a film of the toner is formed on the surface of the photoreceptor. By using the cleaning blade mentioned above for the image forming apparatus using such low temperature fixable toner, chance of occurrence of the toner fixation problem and the filming problem can be reduced. Further, since the edge 62*e* of the cleaning blade 62 hardly deforms in a cleaning operation, the cleaning blade can maintain good robustness, i.e., the cleaning blade can stably perform a good cleaning operation even when the environmental conditions change and/or the amount of toner remaining on the surface of a photoreceptor changes.

The blade of the second embodiment will be described by reference to a verification experiment 2.

Several cleaning blades were prepared by changing the material constituting the elastic blade 622, the material constituting the cover layer 623, and the width and thickness of the cover layer, and the cleaning blades were evaluated with respect to durability. In this regard, the urethane rubbers 1-5 mentioned above for use in the verification experiment 1 were also used for the verification experiment 2.

1. Grinding Treatment

The front end portion of lower surface 62*b* of the blade was ground using a fine polishing sheet (lapping film sheet) from 3M Japan to form the ground edge 62*c*' (illustrated in FIG. 9).

Specifically, the lapping film sheet was fixed on the outer surface of a cylindrical substrate, and the front end portion of the lower surface 62*b* of the urethane rubber elastic blade was contacted with the lapping film sheet and the cylindrical substrate was rotated to grind the front end portion. By using a proper lapping film sheet while changing the treatment time, targeted obtuse-angled edges were prepared (i.e., the lower surface 62*b* was ground at the width (b) illustrated in FIG. 9).

The width of the treated portion means the width (b) illustrated in FIG. 9.

(1) Grinding Treatment 5
Lapping film sheet: #8000 with grain size of 1 μm
Width (b): 10 μm (2) Grinding Treatment 6
Lapping film sheet: #8000 with grain size of 1 μm
Width (b): 30 μm (3) Grinding Treatment 7
Lapping film sheet: #15000 with grain size of 0.3 μm
Width (b): 5 μm (4) Grinding Treatment 8
Lapping film sheet: #8000 with grain size of 1 μm
Width (b): 35 μm (5) Grinding Treatment 9
Lapping film sheet: #6000 with grain size of 2 μm
Width (b): 20 μm By performing the grinding treatments 5-9, elastic blades which are illustrated in FIG. 9 and which have the obtuse-angled edges 62*d* and 62*c*, were prepared.

The cover layers 1-5 mentioned above in the verification experiment 1 were also used for this verification experiment 2.

Next, the image forming apparatus used for the verification experiment 2 will be described.

A strip-shaped elastic blade (622) having a thickness of 1.8 mm was prepared using one of the urethane rubbers 1-5 mentioned above. After front end portion of the lower surface 62*b* of the elastic blade 622 was subjected to a grinding treatment, one of the cover layers 1-5 mentioned above was formed on the tip portion of the elastic blade 622 by spray coating.

Specifically, a cover layer coating liquid was repeatedly applied on a portion of the tip surface (62*a*) of the elastic blade (622) by a spray gun while moving the spray gun at a speed of 10 mm/s so that the cover layer has the predetermined thickness. After drying the coated cover layer coating liquid for 3 minutes to an extent such that the resultant cover layer is not damaged when a finger is contacted therewith, the same coating operation was performed on a front end portion of the lower surface (62*b*) of the elastic blade to form a cover layer on the portion of the lower surface. After drying the coated cover layer coating liquid for 3 minutes to an extent such that the resultant cover layer is not damaged when a finger is contacted therewith, the resultant cover layer on the tip surface (62*a*) and the lower surface (62*b*) was irradiated with ultraviolet rays under the following conditions to crosslink the cover layer.

Power of lamp: 140 W/cm
Irradiating speed of lamp: 5 m/min
Irradiation times: 5 times (5 passes)

In this regard, a masking tape was attached to the portions of the tip surface (62*a*) and the lower surface (62*b*) so that the cover layer is formed on the predetermined portions of the tip surface and the lower surface.

Each of the thus prepared elastic blades 622 having the cover layer 623 thereon was fixed to a holder (621) made of a metal plate using an adhesive to prepare cleaning blades 62 of Examples 6-10 and Comparative Examples 6-10. Each of the cleaning blades was set to a color copier IMAGIO MP C4500 from Ricoh Co., Ltd., which has the same structure as that of the image forming apparatus illustrated in FIG. 1, to be evaluated as described below. In this regard, the entry amount (deformation amount) of the contact edge of the cleaning blade and the setting angle of the blade were controlled so as to be the predetermined amount and a predetermined angle so that the pressure and the cleaning angle of the blade become constant.

The polymerization toner mentioned above in the verification experiment 1 was also used for this verification experiment 2.

The verification experiment 2 was performed under the following conditions.

1. Environmental conditions in the laboratory: 21° C. 65% RH

2. Cleaning blade evaluation test: A running test in which 50,000 copies of an A-4 size chart having an image area ratio of 5% are produced in such a manner that three prints are formed per job and the recording paper is fed in such a direction that the longer sides of the recording paper become perpendicular to the feeding direction was performed.

The evaluation items were as follows.

Evaluation Items

1. Defective cleaning: 20 copies of an A-4 size image including three stripe images with a width of 43 mm (which are perpendicular to the paper feeding direction) were formed after the running test. The stripe images were visually observed to determine whether defective cleaning is caused.

2. Width of abraded portion: The width of the abraded portion of the blade (illustrated in FIG. 8) was measured. In this regard, the abraded portion includes the ground portion of the edge.

3. Fixation of toner to the edge of the blade: After the running test, the edge and the vicinity of the edge within a range of 1 mm were observed with a microscope to determine whether the toner is fixedly adhered thereto.

The verification experiment 2 includes Examples 6-10 and Comparative Examples 6-10 below. The thickness of the cover layer was determined by observing the cross-section of a cover layer, which was formed on another of the elastic blade by the same method, using a microscope VHX-100 from Keyence Corp. The cross-section was obtained by cutting the elastic blade with the cover layer using a trimming razor from Nisshin EM Corp. for use in preparing a sample for scanning electron microscopes (SEM).

Example 6

The cleaning blade of Example 6 is as follows.

1. Base urethane rubber: urethane rubber 2
2. Edge grinding treatment: edge grinding treatment 2
3. Cover layer: cover layer 3
4. Thickness of cover layer on tip surface 62*a* and lower surface 62*b*: 2.0 μm
5. Width of cover layer on tip surface 62*a*: 1.0 mm The evaluation results are as follows.

1. Width of abraded portion: 11.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Example 7

The cleaning blade of Example 7 is as follows.

1. Base urethane rubber: urethane rubber 3
2. Edge grinding treatment: edge grinding treatment 1
3. Cover layer: cover layer 3
4. Thickness of cover layer on tip surface 62*a* and lower surface 62*b*: 1.0 μm
5. Width of cover layer on tip surface 62*a*: 1.0 mm The evaluation results are as follows.

1. Width of abraded portion: 10.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Example 8

The cleaning blade of Example 8 is as follows.

1. Base urethane rubber: urethane rubber 1
2. Edge grinding treatment: edge grinding treatment 5
3. Cover layer: cover layer 1
4. Thickness of cover layer on tip surface 62*a* and lower surface 62*b*: 1.0 μm
5. Width of cover layer on tip surface 62*a*: 0.9 mm The evaluation results are as follows.

1. Width of abraded portion: 9.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Example 9

The cleaning blade of Example 9 is as follows.

1. Base urethane rubber: urethane rubber 3
2. Edge grinding treatment: edge grinding treatment 2
3. Cover layer: cover layer 4
4. Thickness of cover layer on tip surface 62*a* and lower surface 62*b*: 0.5 μm
5. Width of cover layer on tip surface 62*a*: 0.9 mm The evaluation results are as follows.

1. Width of abraded portion: 20.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Example 10

The cleaning blade of Example 10 is as follows.

1. Base urethane rubber: urethane rubber 4
2. Edge grinding treatment: edge grinding treatment 1
3. Cover layer: cover layer 2
4. Thickness of cover layer on tip surface 62*a* and lower surface 62*b*: 2.0 μm
5. Width of cover layer on tip surface 62*a*: 1.0 mm The evaluation results are as follows.

1. Width of abraded portion: 13.0 μm
2. Fixation of toner to edge of cleaning blade: Toner was not fixedly adhered to the edge.
3. Defective cleaning: Defective cleaning was not caused.
4. Fluttering sound problem: The fluttering sound problem was not caused.

Comparative Example 6

The cleaning blade of Example Comparative Example 6 is as follows.

1. Base urethane rubber: urethane rubber 1
2. Edge grinding treatment: No edge grinding treatment was performed.
3. Cover layer: cover layer 3
4. Thickness of cover layer on tip surface 62*a* and lower surface 62*b*: 0.3 μm
5. Width of cover layer on tip surface 62*a*: 1.0 mm The evaluation results are as follows.

1. Width of abraded portion: 23.0 μm
2. Fixation of toner to edge of cleaning blade: Toner was not fixedly adhered to the edge.
3. Defective cleaning: Three streak images were formed due to defective cleaning.
4. Fluttering sound problem: The fluttering sound problem was not caused.
5. The tip surface 62*a* was abraded due to the everted-tip problem.

Comparative Example 7

The cleaning blade of Example Comparative Example 7 is as follows.

1. Base urethane rubber: urethane rubber 5
2. Edge grinding treatment: edge grinding treatment 3
3. Cover layer: cover layer 5
4. Thickness of cover layer on tip surface 62*a* and lower surface 62*b*: 2.0 μm
5. Width of cover layer on tip surface 62*a*: 1.8 mm The evaluation results are as follows.

1. Width of abraded portion: 20.0 μm
2. Fixation of toner to edge of cleaning blade: Toner was not fixedly adhered to the edge.
3. Defective cleaning: Three streak images were formed due to defective cleaning.
4. Fluttering sound problem: The fluttering sound problem was not caused.

Comparative Example 8

The cleaning blade of Example Comparative Example 8 is as follows.

1. Base urethane rubber: urethane rubber 4
2. Edge grinding treatment: edge grinding treatment 4
3. Cover layer: cover layer 4
4. Thickness of cover layer on tip surface 62*a* and lower surface 62*b*: 3.0 μm
5. Width of cover layer on tip surface 62*a*: 1.0 mm The evaluation results are as follows.

1. Width of abraded portion: 31.0 μm
2. Fixation of toner to edge of cleaning blade: Toner was not fixedly adhered to the edge.
3. Defective cleaning: Two streak images were formed due to defective cleaning.
4. Fluttering sound problem: The fluttering sound problem was caused.

Comparative Example 9

The cleaning blade of Example Comparative Example 9 is as follows.

1. Base urethane rubber: urethane rubber 2
2. Edge grinding treatment: No edge grinding treatment was performed.
3. Cover layer: cover layer 5
4. Thickness of cover layer on tip surface 62*a* and lower surface 62*b*: 10.0 μm
5. Width of cover layer on tip surface 62*a*: 1.8 mm The evaluation results are as follows.

1. Width of abraded portion: 20.0 μm
2. Fixation of toner to edge of cleaning blade: Toner was not fixedly adhered to the edge.
3. Defective cleaning: Two streak images were formed due to defective cleaning.
4. Fluttering sound problem: The fluttering sound problem was caused.

Comparative Example 10

The cleaning blade of Example Comparative Example 10 is as follows.

1. Base urethane rubber: urethane rubber 3
2. Edge grinding treatment: No edge grinding treatment was performed.
3. Cover layer: No cover layer was formed,
4. Thickness of cover layer on tip surface 62*a* and lower surface 62*b*: 0 μm
5. Width of cover layer on tip surface 62*a*: 0 mm The evaluation results are as follows.

1. Width of abraded portion: 12.0 μm
2. Fixation of toner to edge of cleaning blade: Toner was fixedly adhered to the edge.
3. Defective cleaning: Three streak images were formed due to defective cleaning.
4. Fluttering sound problem: The fluttering sound problem was not caused.
5. The tip surface 62*a* was abraded due to the everted-tip problem.

The verification experiment 2 is summarized in Tables 2-1 and 2-2 below.

TABLE 2-1

| | Base urethane | Edge grinding treatment | Cover layer | Thickness of cover layer (μm) | Width of cover layer on tip surface (62a) (mm) |
|---|---|---|---|---|---|
| Example 6 | 2 | 2 | 3 | 2.0 | 1.0 |
| Example 7 | 3 | 1 | 3 | 1.0 | 1.0 |
| Example 8 | 1 | 5 | 1 | 1.0 | 0.9 |
| Example 9 | 3 | 2 | 4 | 0.5 | 0.9 |
| Example 10 | 4 | 1 | 2 | 2.0 | 1.0 |
| Comparative Example 6 | 1 | — | 3 | 0.3 | 1.0 |
| Comparative Example 7 | 5 | 3 | 5 | 2.0 | 1.8 |
| Comparative Example 8 | 4 | 4 | 4 | 3.0 | 1.0 |
| Comparative Example 9 | 2 | — | 5 | 10.0 | 1.8 |
| Comparative Example 10 | 3 | — | — | — | — |

TABLE 2-2

| | Width of abraded portion (μm) | Fixation of toner to cleaning blade | Defective cleaning | Fluttering sound problem | Others |
|---|---|---|---|---|---|
| Example 6 | 11 | No | No | No | |
| Example 7 | 10 | No | No | No | |
| Example 8 | 9 | No | No | No | |
| Example 9 | 20 | No | No | No | |
| Example 10 | 13 | No | No | No | |
| Comparative Example 6 | 23 | No | Three streak images | No | Tip surface is abraded. |
| Comparative Example 7 | 20 | No | Three streak images | No | |
| Comparative Example 8 | 31 | No | Two streak images | Yes | |
| Comparative Example 9 | 20 | No | Two streak images | Yes | |
| Comparative Example 10 | 12 | Yes | Three streak images | No | Tip surface is abraded. |

It is clear from Tables 2-1 and 2-2 that the cleaning blades of Examples 6-10, which were prepared by grinding the front end portion of the lower surface 62*b* and then forming a cover layer thereon, did not cause defective cleaning, the toner fixation problem, the fluttering sound problem, and other problems such as abrasion of the tip surface due to the everted-tip problem even when the blades were repeatedly used. However, the cleaning blades of Comparative Examples 6 and 9, which were prepared by forming a cover layer on a right angled edge 62*c* and the vicinity thereof without grinding the edge, caused defective cleaning, the fluttering sound problem and tip surface abrasion due to the everted-tip problem after being repeatedly used. The cleaning blade of Comparative Example 10, which has no cover layer, caused defective cleaning, the toner fixation problem, tip surface abrasion due to the everted-tip problem after being repeatedly used.

In addition, it is clear that the width of the ground portions of the tip surface 62*a* and the lower surface 62*b* is preferably from 10 μm to 30 μm. Since the width of the cleaning blade of Comparative Example 8 is greater than the range, the cleaning blade causes defective cleaning after 50,000 copies were produced. This is because the width of the abraded portion of the blade is too large after 50,000 copies were produced. Further, since the width of the cleaning blade of Comparative Example 7 is less than the range, the cleaning blade causes defective cleaning after 50,000 copies were produced.

In the first and second embodiments mentioned above, methods of forming the obtuse-angled edges 62*d* and 62*e* by grinding the edge 62*c* or the front end portion of the lower surface 62*b*. However, the obtuse-angled edge forming method is not limited thereto, and for example, a method in which an elastic blade (622) having one or more obtuse-angled edges is prepared and then a cover layer (623) is formed on a portion of the elastic blade including the edge can be used.

The above-mentioned blades are merely several examples of the cleaning blade of this disclosure. Hereinbefore, the cleaning blade of this disclosure has been described by reference to blades having two obtuse-angled edges, but is not limited thereto. The cleaning blade of this disclosure has one or more obtuse-angled edges, and one of the obtuse-angled edges is contacted with a member to be cleaned.

This disclosure includes the following embodiments and the effects thereof are as follows.

Embodiment A

The cleaning blade (62) of the embodiment A of this disclosure includes an elastic blade 622, and an edge of the tip portion of the elastic blade is contacted with a surface of a member to be cleaned (such as photoreceptor 3) to remove a powdery material such as toner from the surface. The elastic blade 622 has an obtuse-angled edge (such as edges 62*d* and 62*e*), and a cover layer 623 which is harder than the elastic blade is formed on a portion of the surface of the tip portion of the elastic blade including the obtuse-angled edge. Even when repeatedly used, the cleaning blade maintains good ability to follow the surface of the member to be cleaned while maintaining good cleaning performance without causing the fluttering sound problem, and the problem in that the cleaning blade has a lack on the tip portion thereof as illustrated in FIGS. 11(*b*) and 11(*c*).

Embodiment B

In addition to the feature of the cleaning blade of embodiment A, the elastic blade 622 of the embodiment B has a feature such that two obtuse-angled edges 62*d* and 62*e* are formed on the tip portion thereof, and one of the edges is contacted with the surface of the member to be cleaned. In this case, the total of the inner angles of the two edges is 270°. In addition to the advantages of the cleaning blade of embodiment A, this cleaning blade further has an advantage such that each of the two edges can be used for cleaning and proper contact conditions can be selected therefor, thereby enhancing the flexibility in setting the cleaning blade (layout and cleaning conditions).

Embodiment C

In addition to the feature of the cleaning blade of embodiment A or B, the elastic blade 622 of the embodiment C further has a feature such that a right-angled edge (62*c*) is ground to form the two obtuse-angled edges 62*d* and 62*e* on the tip portion of the cleaning blade. In addition, since the grinding treatment is performed, the ground surface of the elastic blade is properly roughened, thereby making it possible for a cover layer coating liquid to easily penetrate into the ground surface. Therefore, the adhesion between the cover layer and the elastic blade can be enhanced, thereby preventing occurrence of deformation of the cleaning blade due to eversion of the tip of the cleaning blade. Accordingly, the cleaning blade can further produce an effect to stably perform a cleaning operation while the tip thereof is evenly abraded.

Embodiment D

In addition to the feature of the cleaning blade of embodiment C, the elastic blade 622 of the embodiment D further has a feature such that the obtuse-angled edge 62*d* formed on the lower surface 62*b* of the elastic blade 622 is contacted with the surface of the member to be cleaned to remove a powdery material such as toner from the surface. As described in the first embodiment, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof as illustrated in FIGS. 11(*b*) and 11(*c*).

Embodiment E

In addition to the feature of the cleaning blade of the embodiment C, the elastic blade 622 of the embodiment E further has a feature such that the obtuse-angled edge 62*e* formed on the tip surface 62*a* of the elastic blade 622 is contacted with the surface of the member to be cleaned to remove a powdery material such as toner from the surface. As described in the second embodiment, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof.

Embodiment F

In addition to the feature of the cleaning blade of any one of the embodiments C to E, the elastic blade 622 of the embodiment F further has a feature such that each of the treated portions of the lower surface 62*b* and the tip surface 62*a* has a width of from 5 μm to 20 μm. As described in the first embodiment, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof.

Embodiment G

In addition to the feature of the cleaning blade of the embodiment F, the elastic blade 622 of the embodiment G further has a feature such that the cover layer is made of an ultraviolet crosslinked resin and has a thickness of from 0.1 μm to 2 μm on each of the lower surface 62*b* and the tip surface 62*a*. As described in the first embodiment, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof.

Embodiment H

In addition to the feature of the cleaning blade of any one of the embodiments C to E, the elastic blade 622 of the embodiment H further has a feature such that each of the treated portion of the lower surface 62*h* has a width of from 10 μm to 30 μm. As described in the second embodiment, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof.

Embodiment I

In addition to the feature of the cleaning blade of the embodiment H, the elastic blade 622 of the embodiment I further has a feature such that the cover layer is made of an ultraviolet crosslinked resin and has a thickness of from 0.5 μm to 2 μm on each of the lower surface 62*b* and the tip surface 62*a*. As described in the second embodiment, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof.

Embodiment J

In addition to the feature of the cleaning blade of any one of the embodiments A to I, the elastic blade 622 of the embodiment J further has a feature such that the tip surface 62*a* has a non-covered portion apart from the obtuse-angled edge 62*e* with a covered portion therebetween, and the width of the non-covered portion is substantially the same as the width of the covered portion. As described in the first and second embodiments, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof.

Embodiment K

In addition to the feature of the cleaning blade of any one of the embodiments A to J, the elastic blade 622 of the embodiment K further has a feature such that the width of the cover layer on the lower surface 62*b* is substantially the same as the width of the cover layer on the tip surface 62*a*. As described in the first and second embodiments, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof.

Embodiment L

In addition to the feature of the cleaning blade of any one of the embodiments A to K, the elastic blade 622 of the embodiment L further has a feature such that the elastic blade is made of a rubber including a urethane group. As described in the first and second embodiments, even when the cleaning blade is repeatedly used, the cleaning blade can maintain good ability to follow the surface of the member to be cleaned while maintaining better cleaning performance without causing the fluttering sound problem, and the problem in that the cleaning blade has a lack on the tip portion thereof.

Embodiment M

The image forming apparatus of the embodiment M of this disclosure includes an image bearing member (such as photoreceptor 3), a toner image forming device (such as combination of a charger, an irradiator, and a developing device) to form a toner image on a surface of the image bearing member, a transferring device to transfer the toner image onto a recoding medium, and a cleaner including a cleaning blade to remove residual toner remaining on the surface of the image bearing member by contacting the cleaning blade to the surface of the image bearing member. The cleaning blade is one of the cleaning blades of the embodiments A to L mentioned above. As mentioned above, even when the cleaning blade is repeatedly used, the cleaning blade maintains good ability to follow the surface of the member to be cleaned while maintaining better cleaning performance without causing the fluttering sound problem, and the problem in that the cleaning blade has a lack on the tip portion thereof. Therefore, the image forming apparatus can produce high quality images for a long period of time.

Embodiment N

The process cartridge of the embodiment N of this disclosure includes an image bearing member (such as photoreceptor 3) to bear a toner image thereon, and a cleaner including a cleaning blade to remove residual toner remaining on the surface of the image hearing member by contacting the cleaning blade to the surface of the image bearing member. The cleaning blade is one of the cleaning blades of the embodiments A to L mentioned above. As mentioned above, even when the cleaning blade is repeatedly used, the cleaning blade maintains good ability to follow the surface of the member to be cleaned while maintaining better cleaning performance without causing the fluttering sound problem, and the problem in that the cleaning blade has a lack on the tip portion thereof. In addition, the process cartridge can be easily attached to or detached from an image forming apparatus.

Additional modifications and variations of the present invention are possible in light of the above teachings. It is therefore to be understood that within the scope of the appended claims the invention may be practiced other than as specifically described herein.

What is claimed is:

1. A cleaning blade comprising:

a strip-shaped elastic blade having an obtuse-angled edge on a tip portion thereof; and a cover layer, which is located on a surface of the tip portion of the elastic blade including the obtuse-angled edge and which is harder than the elastic blade, wherein the obtuse-angled edge having the cover layer thereon is contacted with a moving surface of a member to be cleaned to remove a powdery material from the moving surface of the member.

2. The cleaning blade according to claim 1, wherein the elastic blade has two obtuse-angled edges on the tip portion thereof, and wherein one of the two obtuse-angled edges is contacted with the moving surface of the member to be cleaned with the cover layer therebetween.

3. The cleaning blade according to claim 2, wherein the two obtuse-angled edges are prepared by grinding a right-angled edge of the elastic blade, said right-angled edge being an intersection of a lower surface of the elastic blade, which extends in a direction perpendicular to a thickness direction of the elastic blade, and a tip surface of the elastic blade, which extends in a direction parallel to the thickness direction of the elastic blade.

4. The cleaning blade according to claim 3, wherein one of the two obtuse-angled edges, which is located on the lower surface of the elastic blade, is contacted with the moving surface of the member to be cleaned with the cover layer therebetween.

5. The cleaning blade according to claim 3, wherein one of the two obtuse-angled edges, which is located on the tip surface of the elastic blade, is contacted with the moving surface of the member to be cleaned with the cover layer therebetween.

6. The cleaning blade according to claim 3, wherein each of the lower surface and the tip surface is ground in a length of from 5 μm to 20 μm to form the two obtuse-angled edges.

7. The cleaning blade according to claim 6, wherein the cover layer consists essentially of an ultraviolet crosslinked resin, and wherein portions of the cover layer located on the lower surface and the tip surface of the elastic blade have a thickness of from 0.1 μm to 2 μm.

8. The cleaning blade according to claim 3, wherein the lower surface is ground in a length of from 10 μm to 30 μm to form the two obtuse-angled edges.

9. The cleaning blade according to claim 8, wherein the cover layer consists essentially of an ultraviolet crosslinked resin, and wherein portions of the cover layer located on the lower surface and the tip surface of the elastic blade have a thickness of from 0.5 μm to 2 μm.

10. The cleaning blade according to claim 1, wherein the tip surface of the elastic blade has a covered portion covered with the cover layer, and a non-covered portion not covered with the cover layer and located apart from the obtuse-angled edge with the covered portion therebetween, and wherein the covered portion has a length substantially equal to a length of the non-covered portion.

11. The cleaning blade according to claim 1, wherein the cover layer extends from the obtuse-angled edge toward the tip surface and the lower surface of the elastic blade in substantially a same length.

12. The cleaning blade according to claim 1, wherein the elastic blade consists essentially of a rubber including a urethane group.

13. An image forming apparatus comprising:

an image bearing member;

a toner image forming device to form an image of toner on a surface of the image bearing member;

a transferring device to transfer the toner image on the surface of the image bearing member to a recording medium; and a cleaner including the cleaning blade according to claim 1 contacted with the surface of the image bearing member to remove the toner remaining on the surface of the image bearing member after the toner image is transferred.

14. A process cartridge comprising:

an image bearing member to bear a toner image on a surface thereof; and a cleaner including the cleaning blade according to claim 1 contacted with the surface of the image bearing member to remove toner remaining on the surface of the image bearing member, wherein the process cartridge is detachably attachable to an image forming apparatus as a single unit.

* * * * *